United States Patent [19]

Takei et al.

[11] Patent Number: 4,795,691

[45] Date of Patent: Jan. 3, 1989

[54] LAYERED AMORPHOUS SILICON PHOTOCONDUCTOR WITH SURFACE LAYER HAVING SPECIFIC REFRACTIVE INDEX PROPERTIES

[75] Inventors: Tetsuya Takei; Tatsuyuki Aoike; Minoru Kato; Keishi Saito, all of Nagahama, Japan

[73] Assignee: Canon Kabushiki Kaisha, Tokyo, Japan

[21] Appl. No.: 38,885

[22] Filed: Apr. 15, 1987

[30] Foreign Application Priority Data

Apr. 17, 1986 [JP] Japan ..... 61-88952
Apr. 22, 1986 [JP] Japan ..... 61-92519
Apr. 22, 1986 [JP] Japan ..... 61-92520

[51] Int. Cl.[4] ..... G03G 5/082

[52] U.S. Cl. ..... 430/67; 430/95; 430/945

[58] Field of Search ..... 430/67, 95

[56] References Cited

U.S. PATENT DOCUMENTS 4,490,453 12/1984 Shirai et al. ..... 430/65

FOREIGN PATENT DOCUMENTS 2614302 10/1976 Fed. Rep. of Germany .

*Primary Examiner*—J. David Welsh

*Attorney, Agent, or Firm*—Fitzpatrick, Cella, Harper & Scinto

[57] ABSTRACT

This is provided an improved light receiving member having at least a photoconductive layer constituted with A-Si(H,X) series material and a surface layer constituted with A-Si(C,O,N)(H,X) for use in electrophotography, etc. which is characterized in that the atom(-C,O,N) is contained in the surface layer in a state that the concentration of the atom(C,O,N) is grown increasingly starting from the position of the interface between the surface layer and the photoconductive layer while leaving a portion corresponding to a refractive index difference ($\Delta n$) [$\Delta n \leqq 0.62$] between the refractive index of the surface layer and that of the photoconductive layer which can be disregarded in the image-making process toward the free surface of the surface layer.

31 Claims, 13 Drawing Sheets

LAYERED AMORPHOUS SILICON PHOTOCONDUCTOR WITH SURFACE LAYER HAVING SPECIFIC REFRACTIVE INDEX PROPERTIES

FIELD OF THE INVENTION

This invention relates to a light receiving member having improved image making efficiencies which is suited for use in high-speed continueous image making systems such as high-speed electrophotographic copying system, high-speed facsimile system and high-speed printer system.

BACKGROUND OF THE INVENTION

There have been proposed various kinds of a light receiving member for use in electrophotography. Among such known light receiving members, the public attention is now focused on such light receiving members having a photoconductive layer formed of an amorphous material containing silicon atoms as the main constituent atoms (hereinafter referred to as "A-Si") as disclosed in unexamined Japanese Patent Publication Sho. 54(1979)-86341 and Sho. 56(1981)-83746 since said photoconductive layer has a high Vickers hardness in addition to having an excellent matching property in the photosensitive region in comparison with that in other kinds of light receiving member and it is not harmful to living things as well as man upon the.

In concrete terms, said light receiving members have a photoconductive layer constituted with an A-Si material containing hydrogen atoms(H) and halogen atoms(X) [hereinafter referred to as "A-Si(H,X)"] and a surface layer being laminated on said photconductive layer which is constituted with a high-resistance amorphous material capable of allowing the transmittance of the light to be used, which serves as a layer to effectively prevent the photoconductive layer from being injected by electric chargein the electrification process and which also serves as a layer to improve the humidity resistance, deterioration resistance upon repeating use, breakdown voltage resistance, use-environmental characteristics and durability of the photoconductive layer.

There have been made various proposals on such surface layers to be disposed on a photoconductive layer of a light receiving member which exhibit the above mentioned functions for the photoconductive layer.

And among those known surface layers, a surface layer constituted with an A-Si(H,X) material containing at least one kind atoms selected from carbon atoms(C), oxygen atoms (O) and nitrogen atoms(N) [hereinafter referred to as "A-Si(C,O,N)(H,X)"] in a relatively small amount is generally evaluated as being the most preferred.

However, for the light receiving members having any of the known surface layers, even if it is the one that has such preferred surface layer as above mentioned, there are still unsolved problems particularly regarding the allowances for the kind of an usable light source and obtaining high quality images at high speed.

That is, firstly, it is extremely difficult to efficiently and to mass-produce the foregoing preferred surface layer having a uniform thickness and a stable film quality. The resultant surface layer will often become such that lacks uniformity of thickness and homogeneity of composition.

In addition, in any case, the light receiving member having such surface layer is to be repeatedly used, for instance, as in the case of an electrophotographic copying system. In that event, the surface layer will be gradually rubbed out by the mechanical actions of a copying sheet, toner, image developing device, cleaner etc. while being subjected to a locally partial abrasive force to thereby result in becoming uneven in thickness. These problems relative to the layer thickness of the surface layer will often bring about a local unevenness in the reflectivity of a light receiving member where there exists an interface between the surface layer and the photoconductive layer such that reflection of light is caused. This leads to making the light receiving member defective in photosensitivity and as a result, the images to be formed will be of an uneven image density which is a serious problem in electrophotography.

Further, as it is required for the above surface layer to be highly resistive in certain respects, there will be occasions which invite generation of residual voltage in the case of using the light receiving member repeatedly, particularly at high speed. In that case, there will be caused a problem that because of said residual voltage, the image quality will be reduced with the progress of the repeating use of the light receiving member. When using the light receiving member repeatedly for a long period of time, there will be another problem relative to the surface layer that its function to serve as a layer to prevent the occurrence of defective images will be gradually reduced to thereby invite the occurrence of defective images.

Further, there are still other problems for such light receiving members having the foregoing surface layer. That is, there will sometimes be such occasion that reflected ray occurs on the surface of the surface layer and another reflected ray occurs at the interface between the surface layer and the photoconductive layer being situated thereunder. In that case, the reflectivities of those reflected rays will be sometimes largely changed in accordance with the wavelength of the reflected ray, the layer thickness of the surface layer and the refractive index of the surface layer that results in bringing about unevenness in the color sensitivity of the photoconductive layer and in making the resultant images to be of uneven density.

The above problems relative to the surface layer were not serious and could be disregarded for the conventional ordinary-speed electrophotographic copying system but they are weighty problems which need to be settled in order for such light receiving members to be made effectively usable in high-speed continuous image-making systems such as a high-speed electrophotographic copying system using a coherent light laser beam as the light source, high-speed facsimile system and high-speed printer system and especially, in digital high-speed in a continuous image-making system.

There have been made the following proposals in order to solve the foregoing problems based upon eliminating relected ray at the interface between the surface layer and the photoconductive layer by adjusting the refractive index of the surface layer and that of the photoconductive layer at the interface: (a) a to make the composition of the surface layer to be closely resemble to or to be equivalent to that of the photoconductive layer at the interface between the two layers, (b) to make the optical band gap of the surface layer to be large enough in view of making light to be effectively impinged into the photoconductive layer and (c) a combination of (a) and (b).

However, any of these methods is not reliable to obtain such a desired light receiving member that can sufficiently satisfy the requirement for the high-speed continuous image-making systems, and there are still left some problems to be solved, which are chiefly directed to residual images and sensitivity related problems likely due to photocarriers to be generated as a result of the occurrence of light absorption at the interface between the surface layer and the photoconductive layer.

Against this background, digital high-speed continous image-making systems gradually have come into wide use. And there is an increased social demand for providing a desirable light receiving member which can sufficiently satisfy the requirements for such digital high-speed continuous image-making systems and which can stably exhibit the desired functions as the light receiving member for said systems.

SUMMARY OF THE INVENTION

This invention is aimed at eliminating the foregoing problems in the conventional light receiving members for use in electrophotography and providing an improved light receiving member which can be effectively used in high-speed continuous image-making systems without accompaniment of the foregoing problems and which can comply with the aforementioned demands.

Another object of this invention is to provide an improved light receiving member which can stably maintain its original spectral sensitivity and which is free from the foregoing problems relative to the ghost and the sensitivity even in the case of continuously forming images at high speed.

The present inventors have conducted extensive studies for overcoming the foregoing problems on the conventional light receiving members and attaining the objects as described above and, as a result, have accomplished this invention on the findings as below described.

That is, the present inventors have experimentally confirmed that the foregoing problems on conventional light receiving members chiefly result from the uneven state for the thickness of the surface layer which originates in the layer formation process, the uneven state which is caused by its repeated use and the occurrence of reflected ray at the interface between the surface layer and the photoconductive layer. The present inventors made further studies based on a clue to the solution of the foregoing problems would lie at the interface between the surface layer and the photoconductive layer, while having due regards also for the thickness of the surface layer.

As a result, the present inventors have found that there exist various phenomena in relation to the thickness of the surface layer, the refractive indexes of the surface layer and the photoconductive layer, and the layer quality and the photoconductivity of the surface layer.

That is, firstly, assuming the refractive index of the surface layer to be n, the thickness of the surface layer to be d, the wavelength of an incident to be $\lambda$, and m and m' respectively to be an integer of 1, 2 or more, the reflected ray becomes small when 2nd is equal to $(m-1/2)\lambda$, but it becomes large when 2nd equals $m'\lambda$.

In concrete examples for the light receiving member having a surface layer constituted with an A-Si(H,X) material containing at least one kind of atoms selected from carbon atoms, oxygen atoms and nitrogen atoms [hereinafter referred to as "A-Si(C,O,N)(H,X)"] of which refractive index (n) is 2.0, when the incident ray is of 800 nm in wavelength from semiconductor laser etc., the occurrence of light reflection is scarce in the cases where the thickness (d) of the surface layer is 1000 Å, 3000 Å and 5000 Å respectively, but it comes to about 30% in the cases where the thickness (d) of the surface layer is 2000 Å, 4000 Å and 6000 Å respectively.

Likewise, when the incident ray is of 550 nm (the central value of visible light) in wavelength, the occurrence of light reflection is scarce in the cases where the thickness (d) of the surface layer is 690 Å, 2060 Å, 3440 Å or more respectively, but it is about 30% in the cases where the thickness (d) of the surface layer is 1380 Å, 2750 Å, 4130 Å or more respectively.

Then, on the basis of these acknowledged phenomena, it was found that in the conventional light receiving member, the reflectivity becomes large in some cases and small in other cases as the thickness of the surface layer becomes large and these changes in the reflectivity (0%⇄30%) mainly bring about the foregoing problems.

On the basis of the above findings, the present inventors have understood that the foregoing problems on the conventional light receiving members could be solved by eliminating or otherwise decreasing the occurrence of reflected rays at the interface between the surface layer and the photoconductive layer even in the case where the thickness of the surface layer in a light receiving member is originally in uneven state or in unevened state because of the repeating use.

On the basis of the above knowledge, the present inventors have tried to change the distributing states of the constituents of the surface layer in a light receiving member aiming to decrease or eliminate the occurrence of reflected ray at the interface between the surface layer and the photoconductive layer.

That is, as a result of making studies in view of the above on a light receiving member having a surface layer constituted with an A-Si(C,O,N)(H,X) material containing a relatively large amount of at least one kind atoms selected from carbon atoms (c), oxygen atoms (o) and nitrogen atoms (N), there were found the following facts.

One of the findings is that when there are established a high concentration layer region in the free surface side of the surface layer and a low concentration layer region in the photoconductive layer side of the surface layer for at least one kind atom selected from carbon (C), oxygen (O) and nitrogen (N) [hereinafter referred to as "the atom (C,O,N)" or simply "(C,O,N)"] and the atom(C,O,N) is incorporated so that the thicknesswise distributing concentration of the atom(C,O,N) becomes discontinuous, the matching between the refractive index of the surface layer and that of the photoconductive layer becomes insufficient and the coordination among the refractive indexes within the surface layer sometimes becomes also insufficient to thereby bring about an unevenness in the spectral sensitivity.

Another finding is that when the atom (C,O,N) is incorporated in the surface layer in the way that the distributing concentration is continuously changed from a reduced state in the photoconductive layer side of the surface layer to a large concentration in the free surface side of the surface layer to make the refractive index of the surface layer and that of the photoconductive layer match at the interface between the two layers and promoting light to be impinged into the photoconductive layer, then although the occurrence of reflected ray at the interface between the surface layer and the photoconductive layer can be somewhat reduced, there is formed a undesired region being inferior in the layer quality. The optical band gap (Egopt) thereof is undesirably narrow in the interface region of the surface layer, whereby photocarriers are generated due to light absorption in that region and they are constrained therein, such that undesired influences are enhanced in the quality of the resulting image.

Then, in consideration of the above facts, the present inventors have made another trial with respect to the distributing state of the atom(C,O,N) in a surface layer of a light receiving member in the way as shown in FIG. 2 as follows.

By the way, FIG. 2 is a fragmentary sectional view of a light receiving member in which are shown a photoconductive layer 203, a surface layer 204, a free surface 207 and a interface 208 between the surface layer 204 and the photoconductive layer 203. And in FIG. 2, the oblique full line shows the increasingly growing state of the distributing concentration of the atom(C,O,N) in the surface layer 204 and $\Delta n$ stands for a refractive index difference between the refractive index of the surface layer 204 and that of the photoconductive layer 203 in the region in the surface layer 204 which is adjacent to the interface 208 between the two layers.

That is, the present inventors have prepared a light receiving member having a photoconductive layer constituted with A-Si:H:X corresponding to the photoconductive layer 203 and a surface layer constituted with A-Si(C,O,N)(H,X) corresponding to the surface layer 204 on an aluminum cylinder, wherein the incorporation of the atom(C,O,N) into the surface layer was conducted as follows.

That is, the atom(C,O,N) was incorporated in the surface layer 204 in the way that its distributing concentration is grown increasingly starting from the position of the interface 208 leaving the refractive index difference ($\Delta n$) between the refractive index (n) of the surface layer 204 and the refractive index (np) of the photoconductive layer 203 at the interface 208 between the two layers, which can be disregarded in the image-making process, toward the free surface 207 of the surface layer 204 as shown in FIG. 2. The resultant light receiving member was examined and, as a result, it was found that the occurrence of reflected ray at the interface 208 can be extremely reduced; the foregoing various problems from the relationships between the surface layer and the photoconductive layer can be almost eliminated; and the light receiving member can be desirably used in a high-speed continuous image-making system since it always and stably brings about high quality images in such high-speed continueous image-making system.

The present inventors have learned from the results of the following Experiments 1 and 3 that the extent of the above refractive index difference ($\Delta n$) is indeed important to obtain a desirable light receiving member which is effectively usable in high-speed continuous image-making systems such as high-speed electrophotographic copying system, high-speed facsimile system, high-speed printer system etc. The refractive index is preferably $\Delta n \geqq 0.62$ and more preferably, $\Delta n \geqq 0.43$.

EXPERIMENT 1

The relation of the amount of the atom(C,O,N) to be contained in the surface layer, the refractive index thereof and the optical band gap were observed.

(1) Preparation of Samples

For the purpose of measuring the refractive index and the width of an optical band gap for a layer to be the surface layer 204, layers having varied compositions of silicon atoms(Si) and carbon atoms(C), layers having varied compositions of Si and oxygen atoms(O) and layers having varied compositions of Si and nitrogen atoms(N) were formed on respective Corning's No. 7059 glass plates (product of Corning Glass Works) using the conventional glow discharging film deposition apparatus.

In each case, the glass plate was placed on the surface of the substrate holder in the deposition chamber and the inner space thereof was adjusted to a vacuum of less than $10^{-7}$ Torr. The glass plate was heated to a predetermined temperature and maintained at that temperature. Thereafter, film forming raw material gases were introduced into the deposition chamber while controlling their flow rates. After the flow rates of the film forming raw material gases and the inner pressure became stable, a discharge energy was applied to thereby form a discharge plasma and to deposit a film on the glass plate.

As for the film forming period, it was so controlled that the thickness of the film to be deposited will be such that any error due to light absorption of the film does not occur, any influence from the constituents of the glass plate does not generate and a wavelength dependency of the light absorption coefficient can be determined.

After a film having an appropriate thickness having been formed on the glass plate, the power source was switched off, the feedings of the film forming raw material gases were stopped, the vacuum atmosphere in the deposition chamber was released to atmospheric pressure then the glass plate was cooled to room temperature. Thereafter the glass plate having a deposited film thereon was taken out from the deposition chamber.

(2) Observations

For each of the above prepared samples, the following measurements were conducted.

(A) Measurement of the Refractive Index

For each of the A-Si:C film, A-Si:O film and A-Si:N film respectively of 1 $\mu$m in thickness, the transmittance against a wavelength of 400 nm to 2600 nm was respectively measured by using the conventional spectrophotometer (product of Hitachi Ltd.).

The results were as shown in FIG. 3(A).

As the transmittance will periodically change in accordance with the interference, the refractive index is determined at the irreducible point (A) being situated between the two points (B) and (C) where the transmittance became 100% in FIG. 3(A).

Assuming the transmittance of the irreducible point (A) to be T%, the following equation (1) can be established between it and the refractive index. In accordance with the equation (1), the refractive index n of each of the A-Si:C film, A-Si:O film and A-Si:N film can be calculated.

$$T/100 = \left\{ \frac{n(1 + n_g)}{n^2 + n_g} \right\}^2 \quad (1)$$

Wherein n is a refractive index of the A-Si:C film, A-Si:O film or A-Si:N film and $n_g$ is the refractive index (1.530) of Corning's No. 7059 glass plate.

(B) Measurement of the Optical Band Gap (Egopt)

For each of the above samples A-Si:C film, A-Si:O film and A-Si:N film, the absorbance against a wavelength of 300 nm to 1000 nm was measured by using the foregoing spectrophotometer. The results were as shown in FIG. 3(B).

Now, the following equation (2) can be established between the absorbance and the extinction coefficient of each of the A-Si:C film, A-Si:O film and A-Si:N film:

$$\alpha = \frac{D}{d \log e} \quad (2)$$

Wherein D equals $-\log T$, D stands for an absorbance, e is 2.718281828 . . . , d stands for the thickness of the A-Si:C film, A-Si:O film or A-Si:N film and $\alpha$ stands for an extinction coefficient of the A-Si:C film, A-Si:O film or A-Si:N film.

And the extinction coefficient can be calculated in accordance with the above equation (2).

The optical band gap can be determined by obtaining an intersecting point of the following equation (3) with x axis.

$$\sqrt{\alpha h\nu} = B(E - E_g) \quad (3)$$

Wherein $\alpha$ is an extinction coefficient, h is Plank's constant, $\nu$ is a frequency of the irradiated light, B is a proportional constant, E is an energy of the irradiated light and $E_g$ is an optical band gap.

The equation (3) can be schematically explained as shown in FIG. 3(C).

(3) Results

The measurement results of the above (2)-(A) and (2)-(B) are put together in FIGS. 3(D), 3(E) and 3(F).

In each of FIGS. 3(D), 3(E) and 3(F), the left ordinate shows the optical band gap (Egopt) (eV), the right ordinate shows the refractive index (n) and the abscissa shows the amount of the carbon atoms contained in the A-Si:C film (C/Si+C) (atomic %), the amount of the oxygen atoms contained in the A-Si:O film (O/Si+O) (atomic %), and the amount of the nitrogen atoms contained in the A-Si:N film successively.

From what are shown in FIGS. 3(D), 3(E) and 3(F), the following facts can be acknowledged.

That is, when the arrival rate of light to the photoconductive layer is intended to increased, the optical band gap (Egopt) of the surface layer is made larger, as much as possible the better. However, in the case of an amorphous material containing silicon atoms, there is a tendency that the refractive index (n) will become small as the optical band gap (Egopt) increases.

In addition to this, the refractive index of the A-Si(H,X) series photoconductive layer is about 3.2 to 3.5. In this respect, it can be understood that the matching between the refractive index of the surface layer and that of the photoconductive layer at the interface between the two layers will become worse as the optical band gap (Egopt) increases; and on the other hand, when the refractive index of the surface layer is made to be matched with the refractive index of the photoconductive layer at the interface between the two layers, the optical band gap (Egopt) in the photoconductive layer side region of the surface layer becomes small accordingly whereby the light absorptive proportion in the surface layer increases, the amount of light to be impinged into the photoconductive layer reduces and the photocarriers to be generated due to the light absorption in the photoconductive layer side region of the surface layer are constrained in that region to thereby bring about problems leading to the occurrence of residual potential.

As a result of examining the $\Delta n$ part shown in FIG. 2 considering the relations of the optical band gap (Egopt), the refractive index, and the amount of the carbon atoms, oxygen atoms or nitrogen atoms shown in FIGS. 3(D), 3(E)and 3(F) while having due regards to the above observations, it was found that the supremum is preferably $\Delta n \leqq 0.62$, more preferably, $\Delta n \leqq 0.43$ for the difference between the refractive index of the interface region of the surface layer with the photoconductive layer and the refractive index of the photoconductive layer.

EXPERIMENT 2(1)

The relationship between the refractive index at the interface between the surface layer and the photoconductive layer and the image density difference was observed.

Firstly, there were provided ten 80 mm$\phi$ diameter aluminum cylinders (Samples Nos. 1 to 10) and another ten 108 mm$\phi$ diameter aluminum cylinders (Sample Nos. 11 to 20). For the former ten cylinders of Sample Nos. 1 to 10, a charge injection inhibition layer, a photoconductive layer then a surface layer were formed continueously on each of them using the conventional glow discharging film deposition apparatus, wherein the formations of the charge injection inhibition layer and the photoconductive layer were carried out under the conditions shown in Table A and the formation of the surface layer was carried out under the conditions shown in Table B.

For the latter ten cylinders of Samples Nos. 11 to 20, a long wavelength light absorptive layer (hereinafter referred to as "IR absorptive layer"), a charge injection inhibition layer, a photoconductive layer then a surface layer were formed continueously on each of them using the conventional glow discharge film deposition apparatus, wherein the formations of the IR absorptive layer, the charge injection inhibition layer and the photoconductive layer were carried out under the conditions shown in Table A and the formation of the surface layer was formed under the conditions shown in Table B.

TABLE A

| | Gas used | Flow rate (SCCM) | Discharging power (W) | Film forming speed (Å/sec.) | Layer thickness (μm) | Substrate temperature |
|---|---|---|---|---|---|---|
| IR absorptive layer | $H_2$ | 360 | 150 | 10 | 0.5 | 280° C. |
| | $SiH_4$ | 110 | | | | |
| | $GeH_4$ | 50 | | | | |
| | NO | 8 | | | | |
| | *$B_2H_6$ | 55 | | | | |
| Change injection inhibition layer | $H_2$ | 360 | 150 | 8 | 3.0 | 280° C. |
| | $SiH_4$ | 110 | | | | |
| | NO | 8 | | | | |
| | *$B_2H_6$ | 55 | | | | |
| Photoconductive layer | $H_2$ | 300 | 300 | 24 | 22 | 280° C. |
| | $SiH_4$ | 300 | | | | |

*diluted with $H_2$gas to be 3000 ppm

TABLE B

| | Gas used | Discharging power (W) | Film forming speed (Å/sec.) | Layer thickness (Å) | Substrate temperature |
|---|---|---|---|---|---|
| Surface layer | $H_2$ | 200 to 350 | 8 to 15 | 5000 | 280° C. |
| | $SiH_4$ | | | | |
| | $CH_4$ | | | | |

(The changes in the composition ratios for the raw material gases in the formation of the surface layer were conducted by automatically controlling the flow rates of the raw material gases along with a previously designed variation coefficient curve by using a mass flow controller.)

For each of the thus obtained twenty samples (Samples Nos. 1 to 20), the refractive index difference (Δn) at the interface between the surface layer and the photoconductive layer and the image density difference (ΔD) were measured.

The Δn value was obtained in accordance with the same procedures as in Experiment 1 using a refractive index measuring sample which was prepared under the same conditions as employed in Experiment 2 for measuring the refractive index of the sample.

The measurement of the ΔD for each of the samples was conducted by setting each of the Samples Nos. 1 to 10 to Canon's NP 755D electrophotographic copying machine (product of Canon Kabushiki Kaisha) and each of the Samples Nos. 11 to 20 to Canon's NP 9030 electrophotographic copying machine (product of Canon Kabushiki Kaisha) and by using Eastman Kodak's standard gray scale chart.

The results of the measurements of the Δn and the ΔD for each of the Samples Nos. 1 to 20 were as shown in FIG. 4.

According to the results shown in FIG. 4, it can be apparently understood that the refractive index difference (Δn) between the refractive index of the surface layer and that of the photoconductive layer at the interface between the two layers is preferably ≦0.62, more preferably ≦0.43. This confirms what were mentioned in Experiment 1.

EXPERIMENT 2(2)

The procedures of Experiment 2(1) were repeated, except that the surface layer forming conditions were changed as shown in Table C, to thereby form an IR adsorptive layer, a charge injection inhibition layer, a photoconductive layer and a surface layer on each of 80 mmϕ diameter aluminum cylinders (Sample Nos. 1′ to 10′) and each of 108 mmϕ diameter aluminum cylinders (Sample Nos. 11′ to 20′).

TABLE C

| | Gas used | Discharging Power (W) | Film forming speed (Å/sec.) | Layer thickness (Å) | Substrate temperature |
|---|---|---|---|---|---|
| Surface layer | $H_2$ | 200 to 350 | 8 to 15 | 5000 | 280° C. |
| | $SiH_4$ | | | | |
| | $O_2$ | | | | |

(The changes in the composition ratios for the raw material gases in the formation of the surface layer were conducted by automatically controlling the flow rates of the raw material gases along with a previously designed variation coefficient curve by using a mass flow controller.)

For each of the thus obtained samples, the Δn and the ΔD were measured by the same procedures as in Experiment 2(1). As a result, the same results as shown in FIG. 4 were obtained.

EXPERIMENT 2(3)

The procedures of Experiment 2(1) were repeated, except that the surface layer forming conditions were changed as shown in Table D, to thereby form an IR adsorptive layer, a charge injection inhibition layer, a photoconductive layer, a surface layer on 80 mmϕ diameter aluminum cylinders (Sample Nos. 1″ to 10″) and 108 mmϕ diameter aluminum cylinders (Sample Nos. 11″ to 20″).

TABLE D

| | Gas used | Discharging Power (W) | Film forming speed (Å/sec.) | Layer thickness (Å) | Substrate temperature |
|---|---|---|---|---|---|
| Surface layer | $H_2$ | 200 to 300 | 8 to 15 | 5000 | 280° C. |
| | $SiH_4$ | | | | |
| | $NH_3$ | | | | |

(The changes in the composition ratios for the raw material gases in the formation of the surface layer were conducted by automatically controlling the flow rates of the raw material gases along with a previously designed variation coefficient carve by using a mass flow controller.)

For each of the thus obtained samples, the Δn and the ΔD were measured by the same procedures as in Experiment 2(1). As a result, the same results as shown in FIG. 4 were obtained.

EXPERIMENT 3

For each of the samples prepared in Experiments 2(1) to 2(3) [Samples Nos. 1 to 20, Samples Nos. 1′ to 20′ and Samples Nos. 1″ to 20″], an optical band gap difference (ΔEgopt) between the optical band gap of the surface layer and that of the photoconductive layer and a sensitivity ($cm^2/erg$) were measured in addition to the measurement of the Δn in Experiments 2(1) to 2(3).

The measurement of the ΔEgopt was conducted in accordance with the procedures mentioned in Experiment 1, and the measurement of the sensitivity was conducted in accordance with the conventional sensitivity measuring method which is widely employed in this technical field.

The results of the measurements were put together in a three-dimensional graph, and the values of the Δn, ΔEgopt and sensitivity were read from said graph for each sample. The results were as shown in Tables E(1) to E(3).

Wherein, there were used Sample No. 1 as the standard for Samples Nos. 2 to 10, Sample No. 11 as the standard for Samples Nos. 12 to 20, Sample No. 1' as the standard for Samples Nos. 2' to 10', Sample No. 11' as the standard for Samples Nos. 12' to 20', Sample No. 1" as the standard for Samples Nos. 2" to 10", and Sample No. 11" as the standard for Samples Nos. 12" to 20" to express the sensitivity of each sample by a relative sensitivity.

It is a matter of course to say that any of those samples used as the standard is satisfactorily usable in a high-speed continueous copying system.

TABLE E (1)

| Sample No. | | Δn | ΔEgopt | Relative sensitivity | |
|---|---|---|---|---|---|
| 80 φmm | 108 φmm | Commonness | Commonness | 80 φmm | 108 φmm |
| 1 | 11 | 0 | 0 | 1.00 | 1.00 |
| 2 | 12 | 0.01 | 0.01 | 1.20 | 1.15 |
| 3 | 13 | 0.25 | 0.3 | 1.30 | 1.20 |
| 4 | 14 | 0.43 | 0.47 | 1.30 | 1.25 |
| 5 | 15 | 0.5 | 0.52 | 1.30 | 1.30 |
| 6 | 16 | 0.62 | 0.57 | 1.30 | 1.30 |
| 7 | 17 | 0.85 | 0.67 | 1.30 | 1.30 |
| 8 | 18 | 1.05 | 0.72 | 1.30 | 1.30 |
| 9 | 19 | 1.2 | 0.75 | 1.30 | 1.30 |
| 10 | 20 | 1.3 | 0.77 | 1.30 | 1.30 |

TABLE E (2)

| Sample No. | | Δn | ΔEgopt | Relative sensitivity | |
|---|---|---|---|---|---|
| 80 φmm | 108 φmm | Commonness | Commonness | 80 φmm | 108 φmm |
| 1' | 11' | 0 | 0 | 1.00 | 1.00 |
| 2' | 12' | 0.01 | 0.01 | 1.20 | 1.15 |
| 3' | 13' | 0.25 | 0.3 | 1.30 | 1.20 |
| 4' | 14' | 0.43 | 0.47 | 1.30 | 1.25 |
| 5' | 15' | 0.5 | 0.52 | 1.30 | 1.30 |
| 6' | 16' | 0.62 | 0.57 | 1.30 | 1.30 |
| 7' | 17' | 0.85 | 0.67 | 1.30 | 1.30 |
| 8' | 18' | 1.05 | 0.72 | 1.30 | 1.30 |
| 9' | 19' | 1.2 | 0.75 | 1.30 | 1.30 |
| 10' | 20' | 1.3 | 0.77 | 1.30 | 1.30 |

TABLE E (3)

| Sample No. | | Δn | ΔEgopt | Relative sensitivity | |
|---|---|---|---|---|---|
| 80 φmm | 108 φmm | Commonness | Commonness | 80 φmm | 108 φmm |
| 1" | 11" | 0 | 0 | 1.00 | 1.00 |
| 2" | 12" | 0.01 | 0.01 | 1.20 | 1.15 |
| 3" | 13" | 0.25 | 0.3 | 1.30 | 1.20 |
| 4" | 14" | 0.43 | 0.47 | 1.30 | 1.25 |
| 5" | 15" | 0.5 | 0.52 | 1.30 | 1.30 |
| 6" | 16" | 0.62 | 0.57 | 1.30 | 1.30 |
| 7" | 17" | 0.85 | 0.67 | 1.30 | 1.30 |
| 8" | 18" | 1.05 | 0.72 | 1.30 | 1.30 |
| 9" | 19" | 1.2 | 0.75 | 1.30 | 1.30 |

TABLE E (3)-continued

| Sample No. | | Δn | ΔEgopt | Relative sensitivity | |
|---|---|---|---|---|---|
| 80 φmm | 108 φmm | Commonness | Commonness | 80 φmm | 108 φmm |
| 10" | 20" | 1.3 | 0.77 | 1.30 | 1.30 |

According to the results shown in Tables E(1) to E(3) and the results shown in FIG. 4, it can be apparently understood that in the case where the Δn is made to be less than 0.62 and the ΔEgopt is made to be more than 0.01, the image density difference becomes less than 0.05 and any of such light receiving members excels in giving a high quality image formation and is accompanied with a superior relative sensitivity.

What were above mentioned means that a light receiving member having a surface layer constituted with A-Si(C,O,N) (H,X) on a photoconductive layer constituted with A-Si(H,X) series material of which the distributing concentration state of the atom(C,O,N) is graded increasingly starting from the position of the interface between the surface layer and the photoconductive layer while leaving a portion corresponding to a refractive index difference (Δn) of $\Delta n \leqq 0.62$ between the refractive index of the surface layer and that of the photoconductive layer, which can be disregarded in the image-making process, toward the free surface of the surface layer is desirably suited for use in a high-speed electrophotographic copying system is that can exhibit desired functions efficiently and effectively in a high-speed continuous copying system.

The present invention has been completed based on the above findings, and it provides an improved light receiving member having at least a photoconductive layer constituted with A-Si(H,X) series material and a surface layer constituted with A-Si(C,O,N)(H,X) for use in electrophotography, etc. which is characterized in that the atom(C,O,N) is contained in the surface layer in a state that the concentration of the atom (C,O,N) is grown increasingly starting from the position of the interface between the surface layer and the photoconductive layer while leaving a portion corresponding to a refractive index difference (Δn) between the refractive index of the surface layer and that of the photoconductive layer which can be disregarded in the image-making process toward the free surface of the surface layer.

DETAILED DESCRIPTION OF THE INVENTION

Figure 1A:
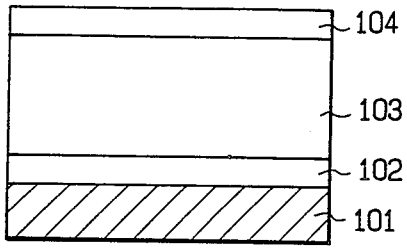
FIGS. 1(A) through 1(C) are schematic cross-sectional views illustrating representative embodiments of a light receiving member to be provided according to this invention.

Representative embodiments of the light receiving member for use in electrophotography according to this invention will now be explained more specifically referring to the drawings. The description is not intended to limit the scope of this invention.

Figure 1B:
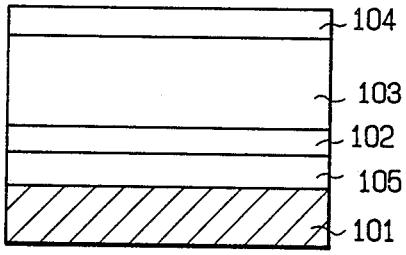
Figure 1C:
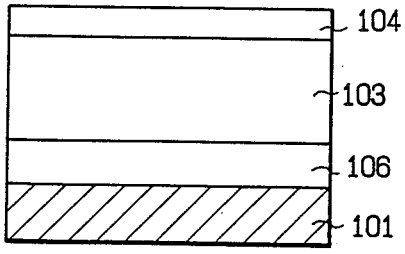
Figure 2:
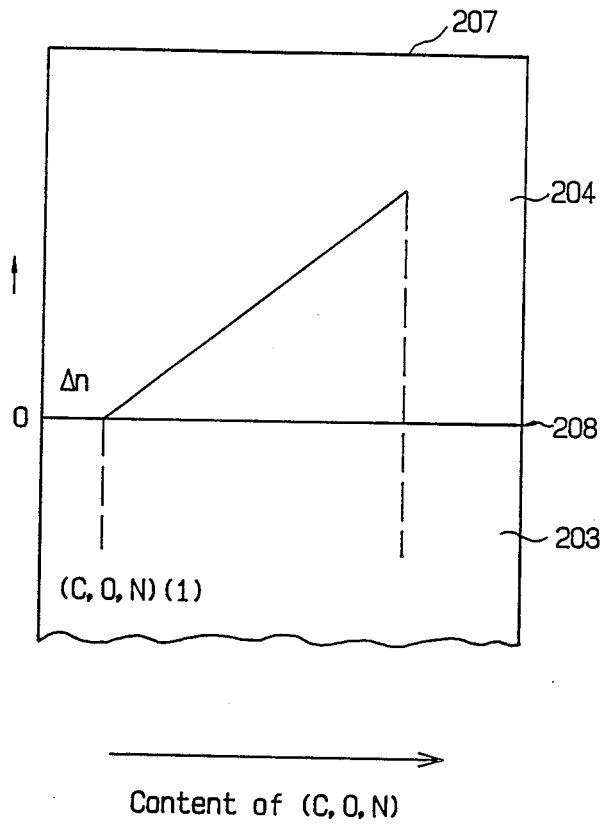
FIG. 2 is a schematic explanatory view for the state of at least one kind atoms selected from carbon atoms, oxygen atoms and nitrogen atoms to be contained in a surface layer of the light receiving member according to this invention.
Figure 3A:
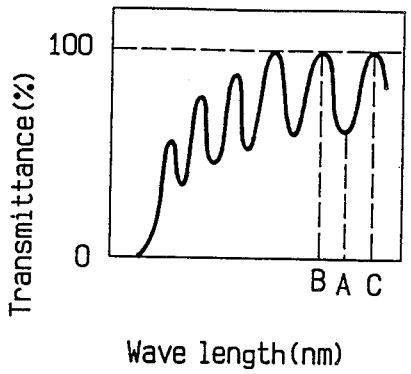
FIG. 3(A) is a schematic explanatory view for measuring the transmittance of a layer sample.
Figure 3B:
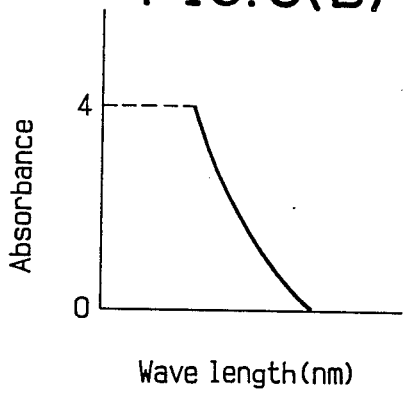
FIG. 3(B) is a schematic explanatory view for measuring the absorbance of a layer sample.
Figure 3C:
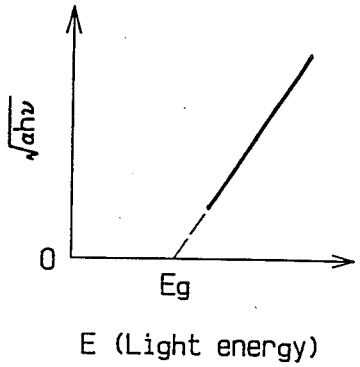
FIG. 3(C) is a schematic explanatory view for measuring an optical band gap of a layer sample.
Figure 3D:
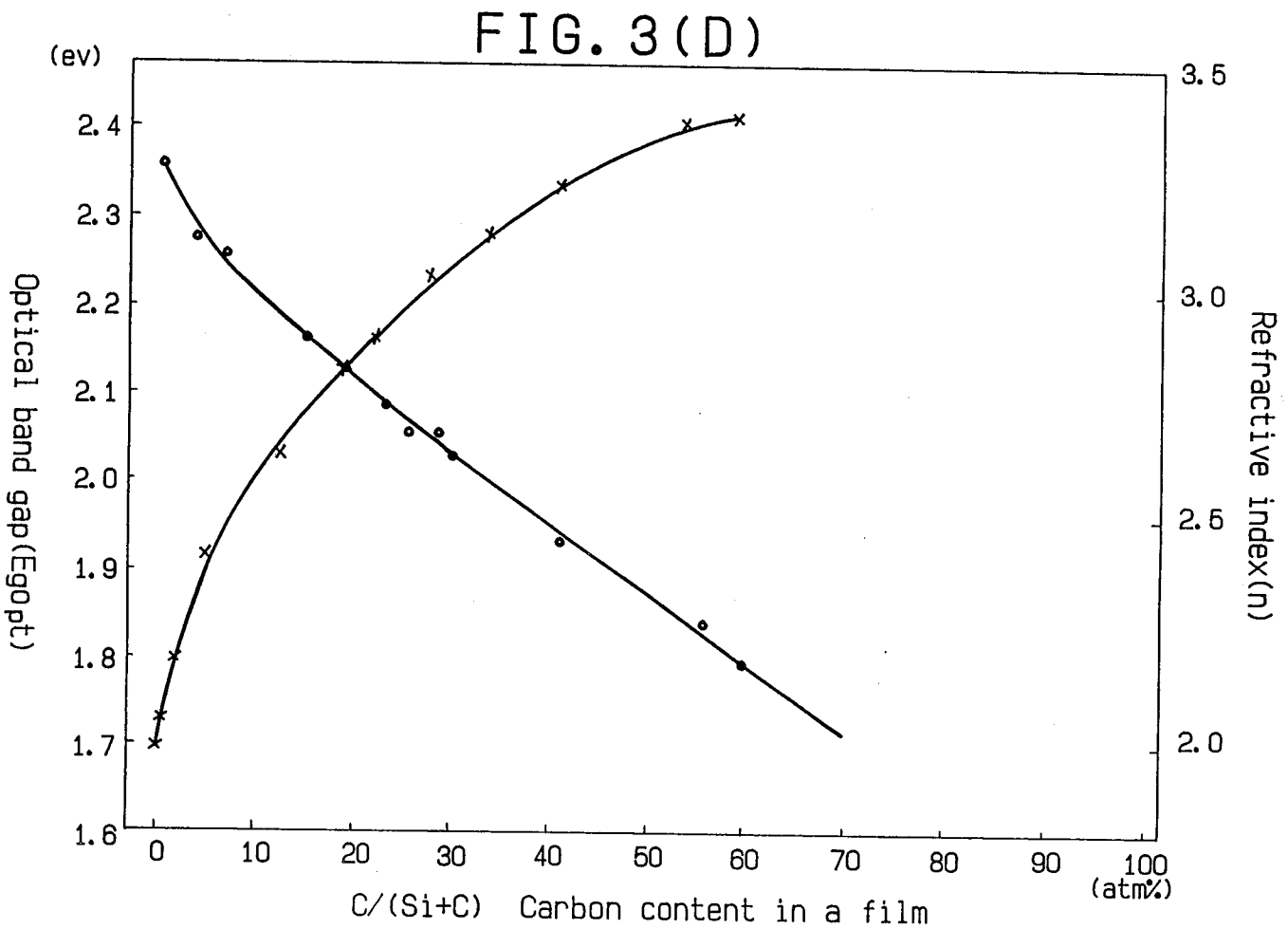
FIG. 3(D) is a graph showing the results of the measurements of optical band gaps and refractive indexes for layer samples containing silicon atoms and carbon atoms.
Figure 3E:
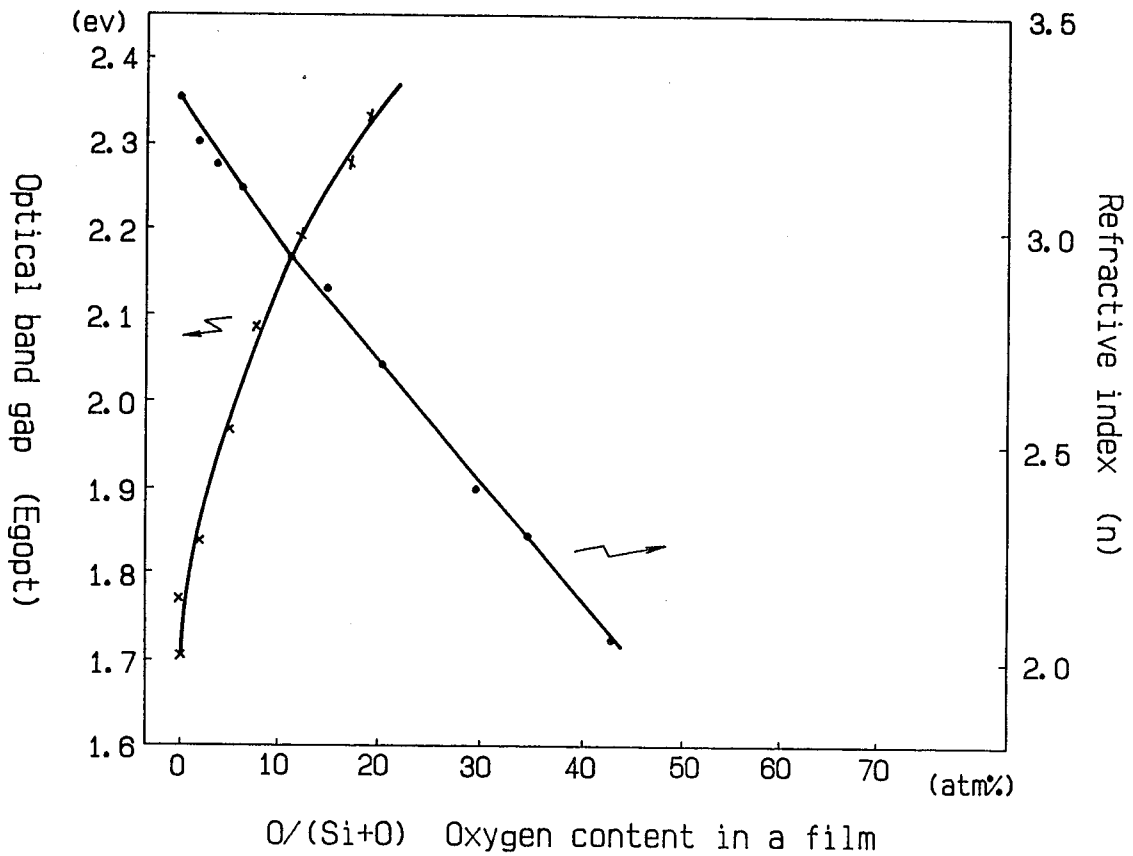
FIG. 3(E) is a graph showing the results of the measurements of optical band gaps and refractive indexes for layer samples containing silicon atoms and oxygen atoms.
Figure 3F:
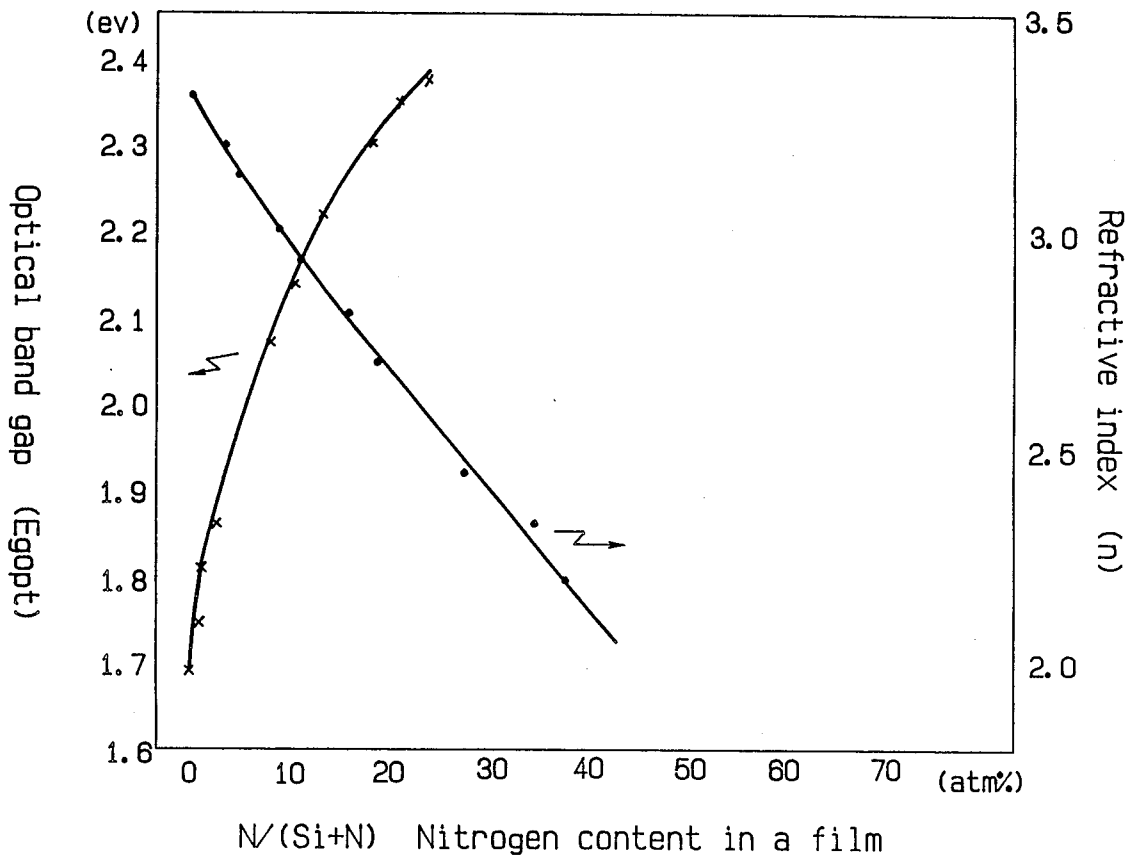
FIG. 3(F) is a graph showing the results of the measurements of optical band gaps and refractive indexes for layer samples containing silicon atoms and nitrogen atoms.
Figure 4:
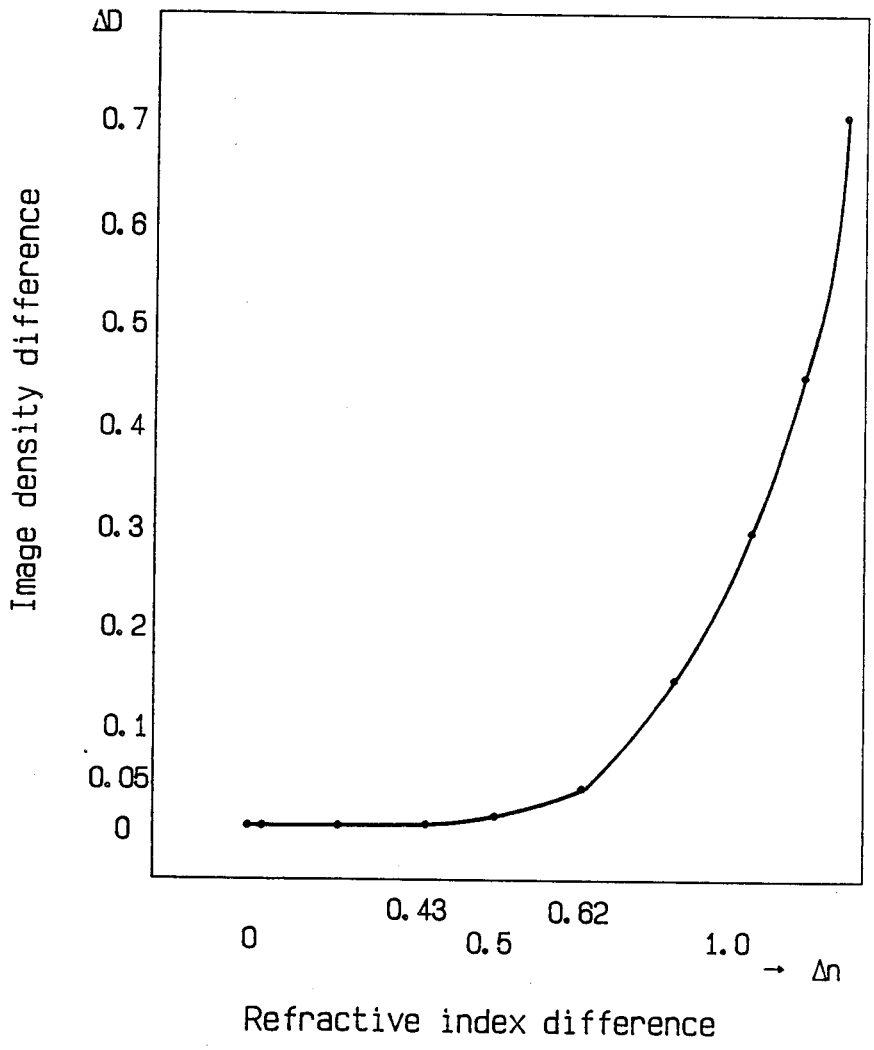
FIG. 4 is a graph showing the relationship between image density differences and refractive index differences for layer samples.

Representative light receiving members for use in electrophotography according to this invention are as shown in FIG. 1(A) through FIG. 1(C), in which are shown substrate 101, charge injection inhibition layer 102, photoconductive layer 103, surface layer 104, long wavelength light absorptive layer (hereinafter referred to as "IR absorptive layer") 105 and layer functioning as the charge injection inhibition layer and also as the IR absorptive layer (hereinafter referred to as "multi-functional layer") 106.

FIG. 1(A) is a schematic view illustrating the typical layer constitution of the light receiving member according to this invention which comprises the substrate 101 and the light receiving layer constituted by the charge injection inhibition layer 102, the photoconductive layer 103 and the surface layer 104.

FIG. 1(B) is a schematic view illustrating another representative layer constitution of the light receiving member according to this invention which comprises the substrate 101 and the light receiving layer constituted by the IR absorptive layer 105, the charge injection inhibition layer 102, the photoconductive layer 103 and the surface layer 104.

FIG. 1(C) is a schematic view illustrating another representative layer constitution of the light receiving member according to this invention which comprises the substrate 101 and the light receiving layer constituted by the multi-functional layer 106, the photoconductive layer 103 and the surface layer 104.

Now, explanation will be made for the substrate and each constituent layer in the light receiving member of this invention.

Substrate 101

The substrate 101 for use in this invention may either be electroconductive or insulative. The electroconductive support can include, for example, metals such as NiCr, stailess steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 in continuous high speed reproduction, it is desirably configurated into an endless belt or cylindrical form.

The thickness of the support member is properly determined so that the light receiving member as desired can be formed.

In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image making process is conducted using coherent monochromatic light such as laser beams.

Charge Injection Inhibition Layer 102

The charge injection inhibition layer is to be disposed under the photoconductive layer 103. And the charge injection inhibition layer is constituted with an A-Si(H,X) material containing group III element as a p-type dopant or group V element as an n-type dopant [hereinafter referred to as "A-Si(III,V):(H,X)"], a poly-Si(H,X) material containing group III element or group V element [hereinafter referred to as "poly-Si(III,V):(H,X)"]or a non-monocrystalline material containing the above two materials [hereinafter referred to as "Non-Si(III,V):(H,X)"].

The charge injection inhibition layer in the light receiving member of this invention functions to maintain an electric charge at the time when the light receiving member is engaged in electrification process and also to contribute to improving the photoelectrographic characteristics of the light receiving member.

In view of the above, to incorporate either the group III element or the group V element into the charge injection inhibition layer is an important factor to efficiently exhibit the foregoing functions.

Specifically, the group III element can include B (boron), Al (aluminum), Ga (gallium), In (indium) and Tl (Thallium). The group V element can include, for example, P (phosphor), As (arsenic), Sb (antimony) and Bi (bismuth). Among these elements, B, Ga, P and As are particularly preferred.

And the amount of either the group III element or the group V element to be incorporated into the charge injection inhibition layer is preferably 3 to $5\times10^4$ atomic ppm, more preferably 50 to $1\times10^4$ atomic ppm, and most preferably $1\times10^2$ to $5\times10^3$ atomic ppm.

As for the hydrogen atoms (H) and the halogen atoms (X) to be incorporated into the charge injection inhibition layer, the amount of the hydrogen atoms (H), the amount of the halogen atoms (X) or the sum of the amounts of the hydrogen atoms and the halogen atoms (H+X) is preferably $1\times10^3$ to $7\times10^5$ atomic ppm, and most preferably, $1\times10^3$ to $2\times10^5$ atomic ppm in the case where the charge injection inhibition layer is constituted with a poly-Si(III,V):(H,X) material and $1\times10^4$ to $6\times10^5$ atomic ppm in the case where the charge injection inhibition layer is constituted with an A-Si(III,V):(H,X) material.

Further, it is possible to incorporate at least one kind atoms selected from oxygen atoms, nitrogen atoms and carbon atoms into the charge injection inhibition layer aiming at improving the bondability of the charge injection inhibition layer not only with the substrate but also with other layer such as the photoconductive layer and also improving the matching of an optical band gap-(Egopt).

In this respect, the amount of at least one kind atoms selected from oxygen atoms, nitrogen atoms and carbon atoms to be incorporated into the charge injection inhibition layer is preferably $1\times10^{-3}$ to 50 atomic %, more preferably $2\times10^{-3}$ to 40 atomic %, and most preferably $3\times10^{-3}$ 30 atomic %.

The thickness of the charge injection inhibition layer in the light receiving member is an important factor also in order to make the layer to efficiently exhibit its functions.

In view of the above, the thickness of the charge injection inhibition layer is preferably 30 Å to 10 μm, more preferably 40 Å to 8 μm, and most preferably, 50 Å to 5 μm.

In the case where the charge injection inhibition layer 102 is constituted with a poly-Si(O,N,C), the layer can be formed by means of plasma chemical vapor deposition (hereinafter referred to as "plasma CVD"). For instance, the film forming operation is practiced while maintaining the substrate at a temperature of 400° to 450° C. in a deposition chamber. In another example of forming said layer, firstly, an amorphous-like film is formed on the substrate being maintained at about 250° C. in a deposition chamber by means of plasma CVD, and secondly, the resultant film is annealed by heating the substrate at a temperature of 400° to 450° C. for about 20 minutes or by irradiating laser beam onto the substrate for about 20 minutes to thereby form said layer.

Photoconductive Layer 103

The photoconductive layer in the light receiving member according to this invention is constituted with an A-Si(H,X) material or a germanium (Ge) or tin(Sn) containing A-Si(H,X) material [hereinafter referred to as "A-Si(Ge,Sn)(H,X)"]. The photoconductive layer 103 may contain the group III element or the group V element respectively having a relevant function to control the conductivity of the photoconductive layer, whereby the photosensitivity of the layer can be improved.

As the group III element or the group V element to be incorporated in the photoconductive layer 103, it is possible to use the same element as incorporated into the charge injection inhibition layer 102. It is also possible to use such element having an opposite polarity to that of the element to be incorporated into the charge injection inhibition layer. And, in the case where the element having the same polarity as that of the element to be incorporated into the charge injection inhibition layer is incorporated into the photoconductive layer 103, the amount may be lesser than that to be incorporated into the charge injection inhibition layer.

Specifically, the group III element can include B (boron), Al (aluminum), Ga (gallium), In (indium) and Ti (thallium), B and Ga being particularly preferred. The group V element can include, for example, P (phosphor), As (arsenic), Sb (antimony) and Bi (bismuth), P and Sb being particularly preferred.

The amount of the group III element or the group V element to be incorporated in the photoconductive layer 103 is preferably $1\times10^{-3}$ to $1\times10^3$ atomic ppm, more preferably, $5\times10^{-2}$ to $5\times10^2$ atomic ppm, and most preferably, $1\times10^{-1}$ to $2\times10^2$ atomic ppm.

The halogen atoms(X) to be incorporated in the layer in case where necessary can include fluorine, chlorine, bromine and iodine. And among these halogen atoms, fluorine and chlorine are particularly preferred. The amount of the hydrogen atoms(H), the amount of the halogen atoms(X) or the sum of the amounts for the hydrogen atoms and the halogen atoms(H+X) to be incorporate in the photoconductive layer is preferably 1 to $4\times10$ atomic %, more preferably, 5 to $3\times10$ atomic %.

Further, in order to improve the quality of the photoconductor layer and to increase it dark resistance, at least one kind selected from oxygen atoms, carbon atoms and nitrogen atoms can be incorporated in the photoconductive layer. The amount of these atoms to be incorporated in the photoconductive layer is preferably 10 to $5\times10^5$ atomic ppm, more preferably 20 to $4\times10^5$ atomic ppm, and, most preferably, 30 to $3\times10^5$ atomic ppm.

The thickness of the photoconductive layer 103 is an important factor in order to effectively attain the object of this invention. The thickness of the photoconductive layer is, therefore, necessary to be carefully determined having due regards so that the resulting light receiving member becomes accompanied with desired characteristics.

In view of the above, the thickness of the photoconductive layer 103 is preferably 3 to 100 μm, more preferably 5 to 80 μm, and most preferably 7 to 50 μm.

Surface Layer 104

The surface layer 104 in the light receiving member according to this invention has such special content as previously detailed and makes a characteristic point of this invention.

The surface layer 104 has a free surface and is to be disposed on the photoconductive layer 103.

And, the surface layer 104 in the light receiving member according to this invention contributes to improve various characteristics commonly required for a light receiving member such as the humidity resistance, deterioration resistance upon repeating use, breakdown voltage resistance, use-environmental characteristics and durability of the light receiving member, to reduce the reflection of an incident ray on the free surface while increasing its transmittance, and to reduce the absorption coefficient of light at the vicinal portion of the interface between the surface layer and the photoconductive layer to thereby effectively decrease the density of a photocarrier to be generated therein.

Further, in the case where the light receiving member according to this invention is used as the electrophotographic photosensitive member, the surface layer 104 contributes to significantly prevent the occurrence of problems relative to the residual voltage and the sensitivity which are often found on the conventional light receiving member particularly in the case of the high-speed continuous image-making process in addition to bringing about the foregoing various effects.

The surface layer 104 in the light receiving member according to this invention is constituted an A-Si material containing at least one kind atoms selected from carbon atoms(C), oxygen atoms(O) and nitrogen atoms(N) and, if necessary, hydrogen atoms(H) and/or halogen atoms(N), that is, A-Si(C,O,N) (H,X), and it contains at least one kind atoms selected from carbon atoms(C), oxygen atoms(O) and nitrogen atoms that is, the atoms(C,O,N) in the particular distributing state as previously detailed.

The amount of the atoms(C,O,N) to be contained in the particular distributing state in the surface layer 104 is the value which is calculated by the equation:

$$\frac{\left[\begin{array}{c}\text{The amount of the atoms(C,O,N)}\\ \text{in the layer}\end{array}\right]}{\left[\begin{array}{c}\text{The amount of}\\ \text{Si in the layer}\end{array}\right]+\left[\begin{array}{c}\text{The amount of the}\\ \text{atoms(C,O,N) in the layer}\end{array}\right]}\times 100$$

Specifically, the amount of the atoms(C,O,N) can be appropriately selected in the range between 0.5 atomic % for the minimum value and 95 atomic % for the maximum value respectively in the thicknesswise distributing concentration.

However, the mean value of the distributing concentration of the atoms(C,O,N) is preferably 20 to 90 atomic %, more preferably 30 to 85 atomic %, and most preferably, 40 to 80 atomic %.

The halogen atoms(X) to be incorporated in the surface layer 104 in case where necesssary can include fluorine, chlorine, bromine and iodine. And among these halogen atoms, fluorine and chlorine are particularly preferred. The amount of the hydrogen atoms(H), the amount of the halogen atoms(X) or the sum of the amounts for the hydrogen atoms and the halogen atoms(H+X) to be incorporate in the surface layer is the value which is calculated by the following equation:

$$\frac{\left[\begin{array}{c}\text{The amount of H}\\ \text{in the layer}\end{array}\right],\left[\begin{array}{c}\text{The amount of}\\ \text{X in the layer}\end{array}\right]\text{or}\left[\begin{array}{c}\text{The amount of}\\ \text{H + X in the layer}\end{array}\right]}{\left[\begin{array}{c}\text{The amount of}\\ \text{Si in the layer}\end{array}\right]+\left[\begin{array}{c}\text{The amount of the}\\ \text{atoms(C,O,N) in the layer}\end{array}\right]+\left[\begin{array}{c}\text{The amount of H}\\ \text{in the layer}\end{array}\right]}\times 100$$

Specifically, the amount of H, the amount of X or the sum of the amount for H and the amount for X(H+X) is preferably 1 to 70 atomic %, more preferably 2 to 65 atomic %, and most preferably 5 to 60 atomic %.

The thickness of the surface layer 104 in the light receiving member of this invention is appropriately determined depending upon the desired purpose.

It is, however, necessary that the thickness be determined in view of relative and organic relationship in accordance with the amounts of the constituent atoms to be contained in the layer or the characteristics required in the relationship with the thickness of other layer. Further, it should be determined also in economical viewpoints such as productivity or mass productivity.

In view of the above, the thickness of the surface layer 104 is preferably $3\times10^{-3}$ to 30 μm, more preferably, $4\times10^{-3}$ to 20 μm, and, most preferably, $5\times10^{-3}$ to 10 μm.

IR Absorptive Layer 105

The IR absorptive layer 105 in the light receiving member of this invention is to be disposed under the charge injection inhibition layer 102.

And the IR absorptive layer is constituted with an A-Si(H,X) material containing germanium atoms(Ge) or/and tin atoms(Sn) [hereinafter referred to as "A-Si(Ge,Sn) (H,X)"], a poly-Si(H,X) material containing germanium atoms (Ge) or/and tin atoms(Sn) [hereinafter referred to as "poly-Si(Ge,Sn) (H,X)"] or a non-monocrystalline material containing the above two materials [hereinafter referred to as "Non-Si(Ge,Sn) (H,X)"].

As for the germanium atoms(Ge) and the tin atoms(Sn) to be incorporated into the IR absorptive layer, the amount of the germanium atoms(Ge), the amount of the tin atoms(Sn) or the sum of the amounts of the germanium atoms and the tin atoms(Ge+Sn) is preferably 1 to $1\times10^6$ atomic ppm, more preferably $1\times10^2$ to $9\times10^5$ atomic ppm, and most preferably, $5\times10^2$ to $8\times10^5$ atomic ppm.

And, the thickness of the IR absorptive layer 105 is preferably 30 Å to 50 μm, more preferably 40 Å to 40 μm, and most preferably, 50 Å to 30 μm.

Multifunctional Layer 106

In the light receiving member of this invention, it is possible to make the above mentioned IR absorptive layer to be such that can function not only as the IR absorptive layer but also as the charge injection inhibition layer. In that case, the object can be attained by incorporating either the group III element or the group V element which is the constituent of the aforementioned charge injection inhibition layer or at least one kind atoms selected from oxygen atoms, carbon atoms and nitrogen atoms into the above IR absorptive layer.

As above explained, the light receiving member to be provided according to this invention excels in the matching property with a semiconductor laser, has a quick photoresponsiveness and exhibits extremely improved electric, optical and photoconductive characteristics, and also excellent breakdown voltage resistance and use-environmental characteristics, since it has a high photosensitivity in all the visible light regions and especially excels in photosensitive characteristics in the long wavelength region.

Particularly, in the case of using the light receiving member of this invention as the electrophotographic photosensitive member, even if it is used in a high-speed continuous electrophotographic image-making system, it gives no undesired effects at all of the residual voltage to the image formation, stable electrical properties, high sensitivity and high S/N ratio, excellent light fastness and property for repeating use, high image density and clear half tone and can provide a high quality image with high resolution power repeatingly.

Preparation of Layers

The method of forming the light receiving layer of the light receiving member will be now explained.

Each layer to constitute the light receiving layer of the light receiving member of this invention can be properly prepared by vacuum deposition method utilizing the discharge phenomena such as glow discharging, sputtering and ion plating methods wherein relevant raw material gases are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy, and hydrogen atoms, halogen atoms and other atoms can be introduced easily together with silicon atoms. The glow discharging method and the sputtering method may be used together in one identical system.

Basically, when a layer constituted with A-Si(H,X) is formed, for example, by the glow discharging method, gaseous starting material capable of supplying silicon atoms(Si) are introduced together with gaseous starting material for introducing hydrogen atoms(H) and/or halogen atoms(X) into a deposition chamber the inside pressure of which can be reduced, glow discharge is generated in the deposition chamber, and a layer composed of A-Si(H,X) is formed on the surface of a substrate placed in the deposition chamber.

To from the layer of A-SiGe(H,X) by the glow discharge process, a feed gas to liberate silicon atoms(Si), a feed gas liberate germanium atoms, and a feed gas to liberate hydrogen atoms(H) and/or halogen atoms(X) are introduced into an evacuatable deposition chamber, in which the glow discharge is generated so that a layer of A-SiGe(H,X) is formed on the properly positioned substrate.

To form the layer of A-SiGe(H,X) by the sputtering process, two targets (a silicon target and germanium target) or a single target composed of silicon and germanium is subjected to sputtering in a desired gas atmosphere.

To form the layer of A-SiGe(H,X) by the ion-plating process, the vapors of silicon and germanium are allowed to pass through a desired gas plasma atmosphere. The silicon vapor is produced by heating polycrystal silicon or single crystal silicon held in a boat, and the germanium vapor is produced by heating polycrystal germanium or single crystal germanium held in a boat. The heating is accomplished by resistance heating or electron beam method (E.B. method).

To form the layer composed of an amorphous silicon containing tin atoms (hereinafter referred to as "A-SiSn(H,X)") by the glow-discharge process, sputtering process, or ion-plating process, a starting material (feed gas) to release tin atoms(Sn) is used in place of the starting material to release germanium atoms which is used to form the layer composed of A-SiGe(H,X) as mentioned above. The process is properly controlled so that the layer contains a desired amount of tin atoms.

The layer may be formed from an amorphous material namely A-Si(H,X) or A-Si(Ge,Sn) (H,X) which further contains the group III element or the group V element, nitrogen atoms, oxygen atoms, or carbon atoms, by the glow-discharge process, sputtering process, or ion-plating process. In this case, the above-mentioned starting material for A-Si(H,X) or A-Si(Ge,Sn) (H,X) is used in combination with the starting materials to introduce the group III element or the group V element, nitrogen atoms, oxygen atoms, or carbon atoms. The supply of the starting materials should be properly controlled so that the layer contains a desired amount of the necessary atoms.

If, for example, the layer is to be formed by the glow-discharge process from A-Si(H,X) containing the atoms(O,C,N) or from A-Si(Ge,Sn) (H,X) containing the atoms(O,C,N), the starting material to form the layer of A-Si(H,X) or A-Si (Ge,Sn) (H,X) should be combined with the starting materials material used to introduce the atoms(O,C,N). The supply of these starting materials should be properly controlled so that the layer contains a desired amount of the necessary atoms.

The surface layer in the light receiving member of this invention is to be disposed on the photoconductive layer and it is constituted with A-Si(C,O,N) (H,X) which contains the atoms(C,O,N) in the special concentration distributing state as previously detailed.

And the surface layer can be also properly formed by vacuum deposition method utilizing the discharge phenomena such as glow discharging, sputtering and ion plating method wherein relevant raw material cases are selectively used.

For example, in order to form the surface layer using the glow discharging process, it is possible to use a mixture of a raw material gas containing silicon atoms(Si) as the constituent atoms, a raw material gas containing the atoms(C,O,N) as the constituent atoms and, optionally, a raw material gas containing hydrogen atoms(H) and/or halogen atoms(X) as the constituent atoms in a desired mixing ratio, or a mixture of a raw material gas containing silicon atoms(Si) as the constituent atoms and a raw material gas containing the atoms(C,O,N) and hydrogen atoms(H) as the constituent atoms also in a desired mixing ratio.

Alternatively, it is also possible to use a mixture of a raw material gas containing the atoms(C,O,N) as the constituent atoms and a raw material gas containing silicon atoms(Si) and hydrogen atoms(H) as the constituent atoms.

In the case of forming the surface layer by way of the sputtering process, it is carried out by selectively using a single crystal or polycrystalline Si wafer, a graphite (C) wafer, $SiO_2$ wafer or $Si_3N_4$ wafer, or a wafer containing a mixture of Si and C, a wafer containing Si and $SiO_2$ or a wafer containing Si and $Si_3N_4$ as a target and sputtering them in a desired gas atmosphere.

In the case of using, for example, a Si wafer as a target, a gaseous starting material for introducing carbon atoms(C) is introduced while being optionally diluted with a dilution gas such as Ar and He into a sputtering deposition chamber thereby forming gas plasmas with these gases and sputtering the Si wafer.

Alternatively, in the case of using Si and C as individual targets, or in the case of using a single target comprising Si and C in admixture, a single target comprising Si and $SiO_2$ in admixture or a single target comprising Si and $Si_3N_4$ in admixture, a raw material for introducing hydrogen atoms or/and halogen atoms as the sputtering gas is optionally diluted with a dilution gas, introduced into a sputtering deposition chamber thereby forming gas plasmas and sputtering is carried out. As the raw material gas for introducing each of the atoms used in the sputtering process, those raw material gases to be used in the glow discharging process may be used as they are.

The conditions upon forming the surface layer constituted with A-Si(C,O,N) (H,X) of the light receiving member of this invention, for example, the temperature of the substrate, the gas pressure in the deposition chamber and the electric discharging power are important factors or obtaining an objective surface layer having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the substrate is preferably from 50° to 350° C. and, most preferably, from 50° to 250° C. The gas pressure in the deposition chamber is preferably from 0.01 to 1 Torr and, most preferably, from 0.1 to 0.5 Torr. Further, the electrical discharging power is preferably from 0.005 to 50 $W/cm^2$, more preferably, from 0.01 to 30 $W/cm^2$ and, most preferably, from 0.01 to 20 $W/cm^2$.

However, the actual conditions for forming the surface layer such as temperature of the substrate, discharging power and gas pressure in the deposition chamber can not usually determined with ease independent of each other. Accordingly, the conditions optimal to the layer formation are desirably determined based on relative and organic relationships for forming the amorphous material layer having desired properties.

The raw material for supplying Si in forming the surface layer of the light receiving member of this invention can include gaseous or gasifiable silicon hydrides (silanes) such as $SiH_4$, $Si_2H_6$,$Si_3H_8$,$Si_4H_{10}$, etc., $SiH_4$ and $Si_2H_6$ being particularly preferred in view of the easy layer forming work and the good efficiency for the supply of Si.

Further, various halogen compounds can be mentioned as the gaseous raw material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2H_6$, $SiCl_4$, and $SiBr_4$. The use of the gaseous or gasifiable silicon halide as described above is particularly advantageous since the layer constituted with halogen atom-containing A-Si can be formed with no additional use of the gaseous starting material for supplying Si.

The gaseous raw material usable for supplying hydrogen atoms can include those gaseous or gasifiable materials, for example, hydrogen gas, halides such as HF, HCl, HBr, and HI, silicon hydrides such as $SiH_4$, $Si_2H_6$, $Si_3H_6$, and $Si_4O_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms(H), which are extremely effective in view of the contrpl for the electrical or photoelectronic properties, can be controlled with ease. Then, the use of the hydrogen halide or the halogen-substituted silicon hydride as described above is particularly advantageous since the hydrogen atoms(H) are also introduced together with the introduction of the halogen atoms.

The raw material to introduce the atoms(C,O,N) may be any gaseous substance or gasifiable substance composed of any of carbon, oxygen, and nitrogen.

Examples of the raw material to be used in order to introduce carbon atoms into the surface layer include saturated hydrocarbons having 1 to 5 carbon atoms such as methane($CH_4$), ethane($C_2H_6$), propane($C_3H_8$), n-butane(n-$C_4H_{10}$), and pentane($C_5H_{12}$); ethylenic hydrocarbons having 2 to 5 carbon atoms such as ethylene($C_2H_4$), propylene($C_3H_6$), butene-1($C_4H_8$), butene-2($C_4H_8$), isobutylene($C_4H_8$), and pentene($C_5H_{10}$); and acetylenic hydrocarbons having 2 to 4 carbon atoms such as acetylene($C_2H_2$), methyl acetylene ($C_3H_4$), and butine(Chd $4H_6$).

Examples of the raw material to be used in order to introduce oxygen atoms into the surface layer introduce oxygen atoms(O) include oxygen ($O_2$) and ozone($O_3$). Additional examples include lower siloxanes such as disiloxane($H_3SiOSiH_3$) and trisiloxane($H_3SiOSiH_2OSiH_3$) which are composed of silicon atoms(Si), oxygen atoms(O), and hydrogen atoms(H).

Examples of the raw material to be used in order to introduce nitrogen atoms into the surface layer include gaseous or gasifiable nitrogen, nitrides and nitrogen compounds such as azide compounds comprising N as the constituent atoms or N and H as the constituent atoms, for example, nitrogen($N_2$), ammonia($NH_3$), hydrazine($H_2NNH_2$), hydrogen azide($HN_3$) and ammonium azide($NH_4N_3$). In addition, nitrogen halide compounds such as nitrogen trifluoride($F_3N$) and nitrogen tetrafluoride($F_4N_2$) can also be mentioned in that they can also introduce halogen atoms(X) in addition to the introduction of nitrogen atoms(N).

DESCRIPTION OF THE PREFERRED EMBODIMENTS

This invention will be described more specifically while referring to Examples, but the invention is not intented to limit the scope only to these examples.

EXAMPLE 1

In this example, there was prepared an electrophtographic photosensitive member in drum form for use in electrophotographic copying system in which a hologen lamp is used as the light source and a filter to cut a long wavelength light is together used in order to rise the color sensitivity.

Figure 5:
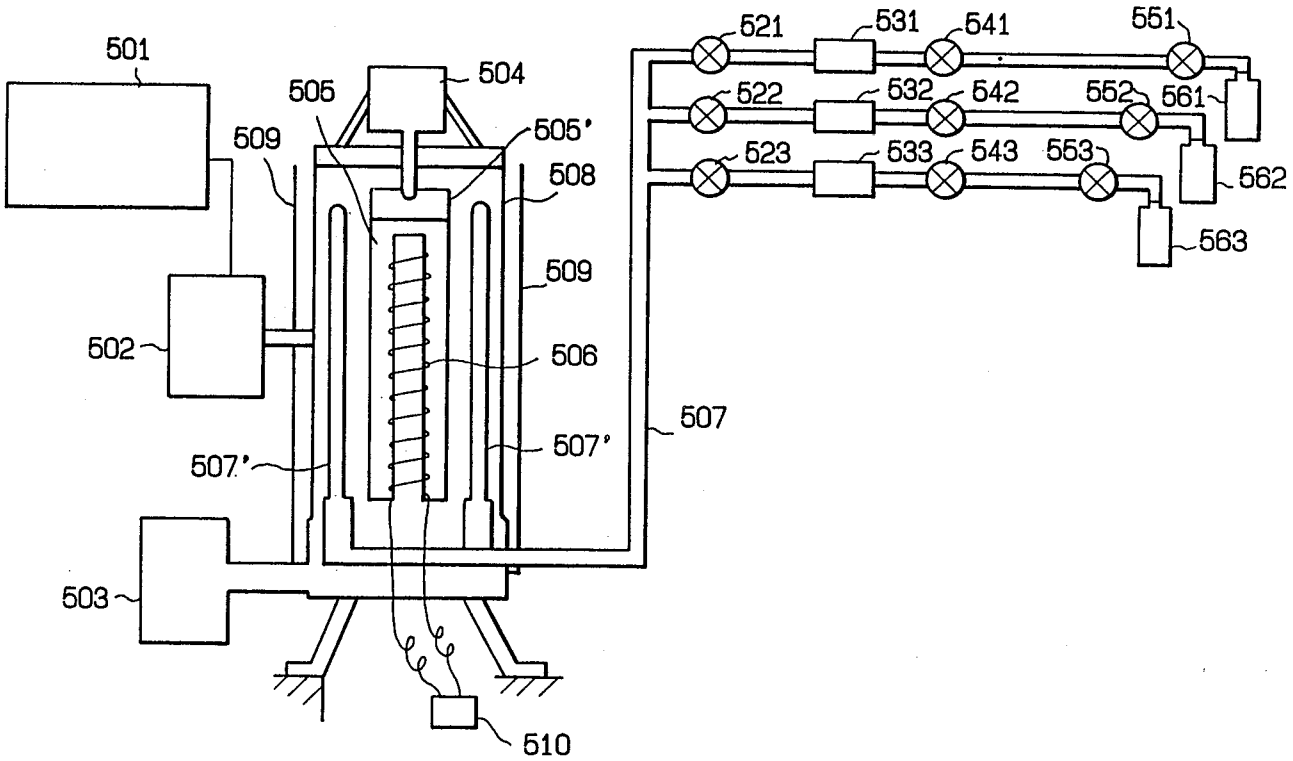
FIG. 5 is a schematic explanatory view of a fabrication apparatus for preparing a light receiving member according to this invention.

In this example, the fabrication apparatus shown in FIG. 5 was used to prepare the above electrophotographic photosensitive member.

Referring FIG. 5, there is shown an aluminum cylinder 505' placed on a substrate holder 505 having a electric heater 506 being electrically connected to power source 510.

The substrate holder 505 is mechanically connected through a rotary shaft to a motor 504 so that the aluminum cylinder 505' may be rotated. The electric heater 506 surves to heat the aluminum cylinder 505'to a predetermine temperature and maintain it at that temperature, and it also serves to aneal the deposited film. 508 stands for the side wall of the deposition chamber.

The side wall 508 acts as a cathod, and the aluminum cylinder 505' is electrically grounded and acts as an anode.

High frequency power source 501 is electrically connected through matching box 502 to the side wall 508 and supplies a high frequency power to the side wall 508 as the cathod to thereby generate a discharge between the cathod and the anode.

507 stands for a raw material gas feed pipe having upright gas liberation pipes 507', 507' respectively being provided with a plurality of gas liberation holes to liberate a raw material gas toward the aluminum cylinder 505'. 503 stands for exhaust system having a diffusion pump and mechanical booster pump to evacuate the air in the deposition chamber. The outer wall face of the deposition chamber is protected by shield members 509, 509.

The other end of each of the raw material gas feed pipe 507 is connected to raw material gas reservoirs 561, 562 and 563. 551 through 553 are regulating valves 541 through 543 are inlet valves, 531 through 533 are mass flow controllers and 521 through 523 are exit valves.

An appropriate raw material gas is reserved in each of the raw material gas reservoirs 561 through 563. For example, there are reserved $H_2$ gas in the gas reservoir 561, silane ($SiH_4$) gas in the gas reservoir 562, and a raw material gas for supplying C, O or H in the gas reservoir 563.

In this example, there was used an aluminum cylinder of 358 mm in length and of 108 mm in diameter as the substrate.

Now, prior to entrance of the raw material gases into the deposition chamber, all the main valves of the gas reservoirs were closed and all the valves and all the mass flow controllers were opened.

Then, the related inner atmosphere was brought to a vacuum of $10^{-7}$ Torr by operating the exhaust system 503. At the same time, the electric heater 506 was activated to uniformly heat the aluminum cylinder 505' to about 250° C. and the aluminum cylinder was maintained at that temperature.

Thereafter, closing all the valves 521 through 523, 541 through 543 and 551 through 553 and opening all the main valves of the gas reservoirs 561 through 563, the secondary pressure of each of the regulating valves 551 through 553 was adjusted to be 1.5 kg/cm$^2$.

Then, adjusting the mass flow controller 531 to 300 SCCM and successively opening the inlet valve 541 and the exit valve 521, $H_2$ gas from the gas reservoir 561 was introduced into the deposition chamber. At the same time, adjusting the mass flow controller 532 to 200 SCCM and successively opening the inlet valve 542 and the exit valve 522, $SiH_4$ gas from the gas reservoir 562 was introduced into the deposition chamber.

After the inner pressure of the deposition chamber became stable at 0.4 Torr, the high frequency power source was switched on to apply a discharge energy of 200 W while adjusting the matching box 502 to generate gas plasmas between the aluminum cylinder 505' and the inner wall of the deposition chamber.

This state maintained to form an A-Si:H layer of 25 μm in thickness.

Successively, switching off the high frequency power source 501, $CH_4$ gas from the gas reservoir 563 was introduced into the deposition chamber by the same procedures as in the case of the $H_2$ gas.

Figure 6A:
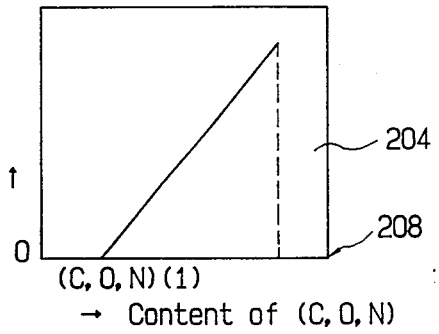
FIGS. 6(A) through 6(L) are sehematic views respectively illustrating the state of at least one kind atoms selected from carbon atoms, oxygen atoms and nitrogen atoms to be contained in a surface layer of the light receiving member according to this invention.
Figure 6B:
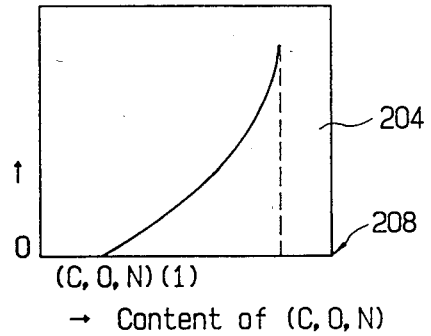
Figure 6C:
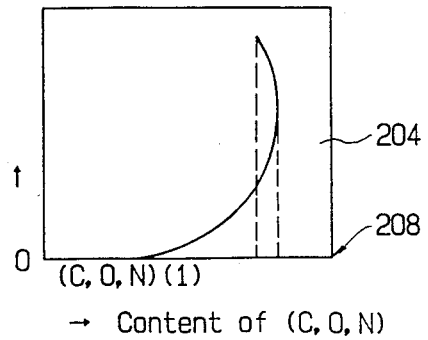
Figure 6D:
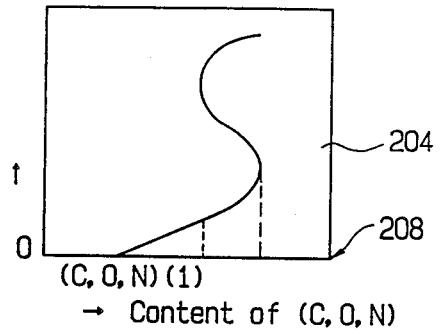
Figure 6E:
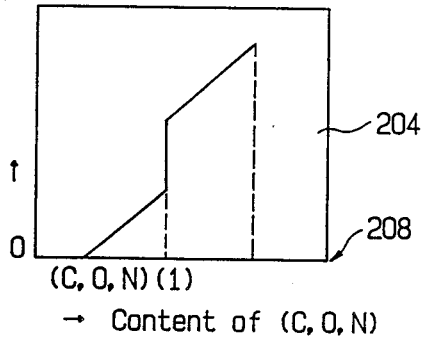
Figure 6F:
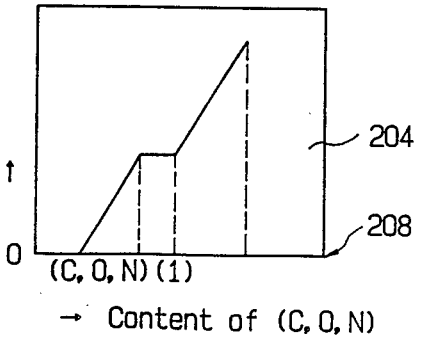
Figure 6G:
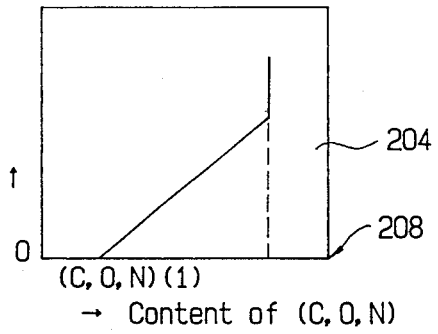
Figure 6H:
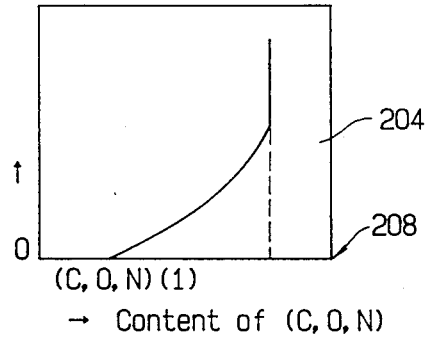
Figure 6I:
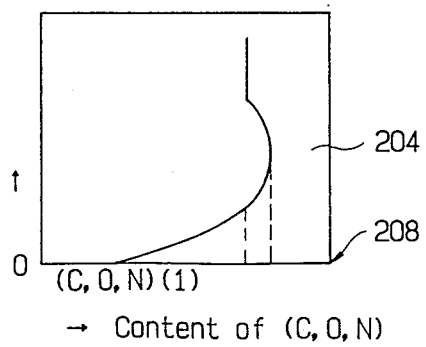
Figure 6J:
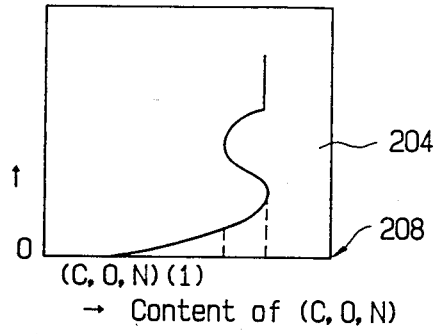
Figure 6K:
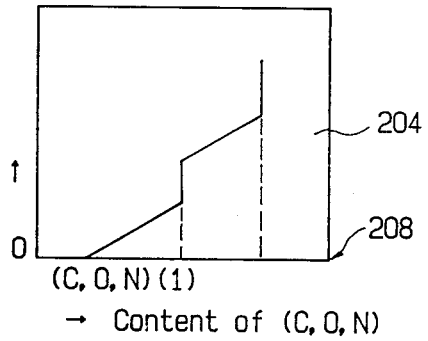
Figure 6L:
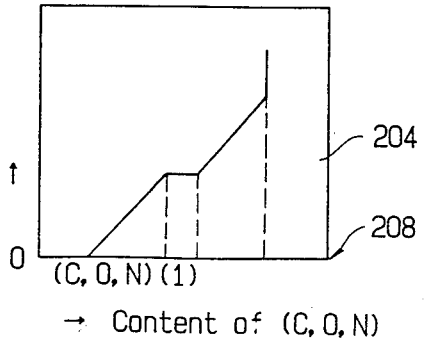

After the inner pressure became stable, the high frequency power source 501 was switched on to apply a discharge energy of 200 W, wherein the flow rates of each of the $H_2$ gas, $SiH_4$ gas and $CH_4$ gas were changed as shown in Table F by adjusting the corresponding mass flow controllers properly so that the distributing concentration state of carbon atoms in the layer to be formed could be made in the state as shown in FIG. 6(A).

TABLE F

| Gas used | Initial Stage | | Final Stage |
|---|---|---|---|
| $H_2$ | 300 SCCM | to | 200 SCCM |
| $SiH_4$ | 200 SCCM | to | 10 SCCM |
| $CH_4$ | 50 SCCM | to | 290 SCCM |

In this way, there was formed an A-SiC:H layer of 0.5 μm in thickness on the previously formed layer.

Finally, switching off the high frequency power source, closing all the valves, switching off the power source for the heater, the aluminum cylinder was cooled to room temperature under vacuum atmosphere and it was taken out from the deposition chamber.

The thus obtained light receiving number was set to modified Canon's electrophotographic copying machine NP7550 (product of Canon Kabushiki Kaisha) to conduct image making on a paper sheet.

Even when the machine was operated at a process speed to output 100 A4 size paper sheets per a minute, every processed paper sheet had high quality images without accompaniment of any ghost and any uneven image density.

And, as an acceleration test under the above conditions, when the above light receiving member was persisted using toner containing abrasives, even after one million shots of a A4 size paper sheet, there was not given any problem such as uneven image density, ghosts etc. although there was found a appreciable change on the thickness of the surface layer.

EXAMPLES 2 TO 12

There were provided eleven aluminum cylinders which are the same kind as used in Example 1.

The procedures of Example 1 were repeated, except that the formation of a surface layer on the photoconductive layer to be previously formed on each of the eleven aluminum cylinders was so conducted that the distributing concentration state of carbon atoms in that layer could be made in the state respectively as shown in FIG. 6(B) to FIG. 6(L) by automatically controlling the flow rates of $SiH_4$ gas, $H_2$ gas and $CH_4$ gas, to thereby prepare eleven light receiving members respectively having the surface layer of 0.5 μm in thickness.

The resultant eleven light receiving members were evaluated by the same procedure as in Example 1. As a result, there were obtained satisfactory results on any of them.

EXAMPLES 13 TO 24

There were provided twelve aluminum cylinders, each of which is 358 mm in length and 108 mm in diameter.

On the surface of each aluminum cylinder, a photoconductive layer then a surface layer were formed under the layer forming conditions shown in Table G to obtain twelve light receiving members, wherein the changes in the flow rates of $SiH_4$ gas, $H_2$ gas and $CH_4$ gas were so made that the carbon atoms distributing concentration state became respectively as shown in FIG. 6(A) to FIG. 6(L) by automatically controlling said flow rates using microcomputer.

The resultant twelve light receiving members were engaged in the same image-making test as in Example 1.

As a result, satisfactory results were obtained on every light receiving member.

TABLE G

| Layer constitution | Gas used | Flow rate | Discharging power | Layer thickness |
|---|---|---|---|---|
| Photoconductive layer | | | | |
| 1st layer region | $SiH_4$ | 200 SCCM | 200 W | 3 μm |
| | $H_2$ | 300 SCCM | | |
| | $B_2H_6$ | 1000→0 ppm | | |
| 2nd layer region | $SiH_4$ | 200 SCCM | | 22 μm |
| | $H_4$ | 300 SCCM | | |
| Surface layer | $SiH_4$ | 200→10 SCCM | | 1.0 μm |
| | $H_2$ | 0 | | |
| | $CH_4$ | 50→290 SCCM | | |

Substrate temperature: 250° C.
Discharging frequency: 13.56 MHz

EXAMPLES 25 TO 36

Figure 7:
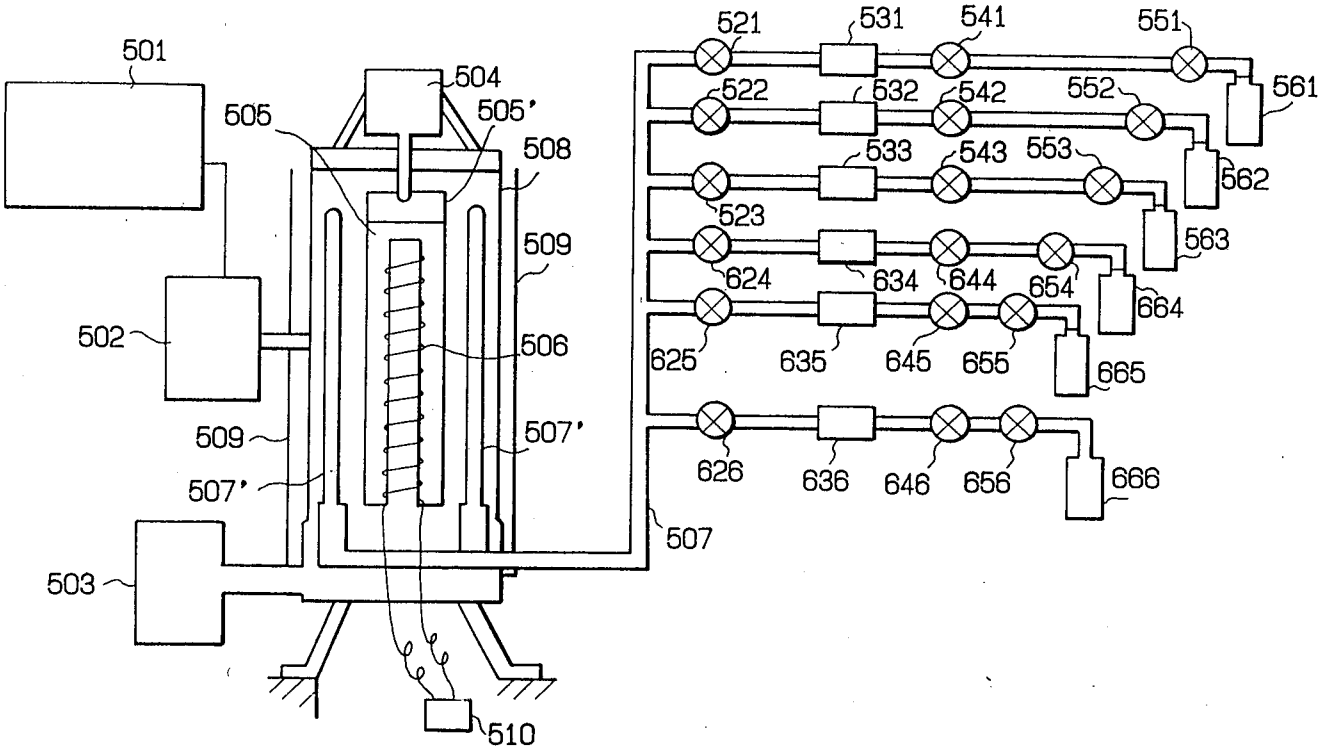
FIG. 7 is a schematic explanatory view of another fabrication apparatus for preparing a light receiving member according to this invention.

In each of Examples 25 to 36, there was prepared an electrophotographic photosensitive member in drum form having an IR absorptive layer, a charge injection inhibition layer, a photoconductive layer and a surface layer for use in laser beam printer in which a 80 μm spot semiconductor laser of 780 nm in wavelength is used as the light source, using the fabrication apparatus shown in FIG. 7.

The apparatus shown in FIG. 7 is a modification of the apparatus shown in FIG. 5 that gas reservoir 664 for NO gas, gas reservoir 665 for diborane diluted with $H_2$ gas ($B_2H_6/H_2$), gas reservoir 666 for $GeH_4$ gas, exit valves 624 through 626, mass flow controllers 634 through 636, inlet valves 644 through 646 and regulating valves 654 through 656 were additionally provided with the apparatus shown in FIG. 5.

In every Example, an aluminum cylinder of 358 mm in length and 80 in diameter was used as the substrate.

Each of the twelve light receiving members was prepared as follows in accordance with the same procedures as in Example 1.

That is, after the related inner atmosphere of the deposition chamber was brought to a predetermined vacuum and the aluminum cylinder was heated to a predetermined temperature, $H_2$ gas, $SiH_4$ gas, NO gas and $GeH_4$ gas were introduced into the deposition chamber respectively at a flow rate of 300 SCCM, 200 SCCM, 15 SCCM and 100 SCCM. At the same time, $B_2H_6/H_2$ gas was also introduced thereinto at a flow rate corresponding to 3000 ppm as for $B_2H_6$ against the $SiH_4$ gas.

After the inner pressure became stable at 0.5 Torr, a high frequency power energy of 200 W was applied to thereby generate gas plasmas, whereby an A-SiGe:H:B:N:O layer of 1 μm in thickness to be the IR absorptive layer was formed on the aluminum cylinder. Stopping the introduction of the $GeH_4$ gas, the above procedures were repeated to thereby for an A-Si:H:B:N:O layer of 5 μm in thickness to be the charge injection inhibition layer on the previous layer.

Successively, stopping the introduction of the NO gas and the $B_2H_6/H_2$ gas, the above procedures were repeated to thereby form an A-Si:H layer to be the photoconductive layer on the charge injection inhibition layer.

Then, switching off the high frequency power source, a surface layer of 0.5 μm in thickness containing carbon atoms respectively in the carbon atoms distributing concentration state as shown in FIG. 6(A) to FIG. 6(L) on the photoconductive layer to thereby obtain twelve light receiving members.

Each of the resultant twelve light receiving members was set to Canon's NP 9030 laser copier and the image-making tests were conducted thereon by the same procedures as in Example 1. As a result, satisfactory results were obtained on every light receiving member as in Example 1.

EXAMPLES 37 TO 48

There were provided twelve aluminum cylinders which are the same kind as used in Example 1.

There were formed a photoconductive layer and a surface layer on each aluminum cylinder to prepare a light receiving member for use in electrophotography using the apparatus shown in FIG. 5.

For the photoconductive layer, carbon atoms were incorporated into the layer aiming at improving the electrification efficiency and the sensitivity.

For the formation of the photoconductive layer in each case, the procedures of Example were repeated, except that $SiH_4$ gas, $H_2$ gas and $CH_4$ gas were introduced into the deposition chamber respectively at a flow rate of 200 SCCM, 300 SCCM and 1 SCCM, to thereby form a layer of 25 μm in thickness to be the photoconductive layer.

Then, in accordance with the procedures of Example 1 for the formation of the surface layer, a layer of 0.5 μm in thickness to be the surface layer was formed in each case while incorporating carbon atoms into the layer in the carbon atoms distributing concentration state respectively as shown in FIG. 6(A) to FIG. 6(L) by regulating the flow rates of $SiH_4$ gas, $H_2$ gas and $CH_4$ gas under automatic control with microcomputer.

The resultant twelve light receiving members were evaluated by the procedures of Example 1.

As a result, satisfactory results were obtained on every light receiving member as in example 1.

EXAMPLE 49

In this example, there was prepared an electrophotographic photosensitive member in drum form for use in electrophotographic copying system in which a halogen lamp is used as the light source and a filter to cut a long wavelength light is together used in order to rise the color sensitivity.

As the substrate, an aluminum cylinder which is the same kind as in Example was used.

On the aluminum cylinder, there were formed a photoconductive layer then a surface layer having a layer thickness of 0.5 μm which is composed with an A-Si:O:H.

The formation of the A-Si:O:H layer as the surface layer was conducted by changing the flow rates of $SiH_4$ gas and $O_2$ gas under the layer forming conditions shown in Table H so that the obygen atoms distributing concentration state in the layer became as shown in FIG. 6(A)

TABLE H

| Gas used | Initial Stage | | Final Stage |
|---|---|---|---|
| $SiH_4$ | 200 SCCM | to | 50 SCCM |
| $H_2$ | 300 SCCM | | 300 SCCM |
| $O_2$ | 5 SCCM | to | 50 SCCM |

The resultant light receiving member was engaged in the same image-making tests as in Example 1.

As a result, there were obtained satisfactory results as in Example 1.

EXAMPLE 50

In this exmple, there was prepared a light receiving member having a photoconductive layer and a layer composed of A-Si:H:O:C to be surface layer on the same kind of aluminum cylinder as in Example 1 in accordance with the same procedures as in the case where the apparatus shown in FIG. 5 as above mentioned.

The formation of the A-Si:H:O:C layer as the surface layer was conducted by changing the flow rates of $SiH_4$ gas, $O_2$ gas and $CH_4$ gas under the layer forming conditions shown in Table I so that the distributing concentration states of the oxygen atoms and the carbon atoms in the layer became as shown in FIG. 6(A).

TABLE I

| Gas used | Initial Stage | | Final Stage |
|---|---|---|---|
| $H_2$ | 300 SCCM | | 300 SCCM |
| $SiH_4$ | 200 SCCM | to | 50 SCCM |
| $O_2$ | 2 SCCM | to | 10 SCCM |
| $CH_4$ | 3 SCCM | to | 40 SCCM |

The resultant light receiving member was engaged in the same image-making tests as in Example 1.

As a result, there were obtained satisfactory results as in Example 1.

EXAMPLE 51

In this example, there was prepared a light receiving member having a photoconductive layer and a layer composed of A-Si:H:F:O to be the surface layer of 0.5 μm in thickness on the same kind of aluminum cylinder as in Example 1 in accordance with the same procedures as in the case where the apparatus shown in FIG. 5 as above mentioned.

The formation of the A-Si:H:F:O layer as the surface layer was conducted by changing the flow rates of $SiH_4$ gas, $SiF_4$ gas and $O_2$ gas under the layer forming conditions shown in Table J so that the distributing concentration state of carbon atoms in the layer became as shown in FIG. 6(A).

TABLE J

| Gas used | Initial Stage | | Final Stage |
|---|---|---|---|
| $H_2$ | 300 SCCM | | 300 SCCM |
| $SiH_4$ | 150 SCCM | to | 30 SCCM |
| $SiF_4$ | 50 SCCM | to | 20 SCCM |
| $O_2$ | 5 SCCM | to | 50 SCCM |

The resultant light receiving member was engaged in the same image-making tests as in Example 1.

As a result, there were obtained satisfactory results as in Example 1.

EXAMPLE 52

In this example, there was prepared a light receiving member having a photoconductive layer and a layer composed of A-Si:H:F:O:C to be the surface layer of 0.5 μm in thickness on the same kind of aluminum cylinder as in Example 1 in accordance with the same procedures as in the case where the apparatus shown in FIG. 5 as above mentioned.

The formation of the A-Si:H:F:O layer as the surface layer was conducted by changing the flow rates of $SiH_4$ gas, $SiF_4$ gas, $O_2$ gas and $CH_4$ gas under the layer forming conditions shown in Table K so that the distributing concentration states of oxygen atoms and carbon atoms in the layer became as shown in FIG. 6(A).

TABLE K

| Gas used | Initial Stage | | Final Stage |
|---|---|---|---|
| $H_2$ | 300 SCCM | | 300 SCCM |
| $SiH_4$ | 150 SCCM | to | 30 SCCM |
| $SiF_4$ | 50 SCCM | to | 20 SCCM |
| $O_2$ | 2 SCCM | to | 10 SCCM |
| $CH_4$ | 3 SCCM | to | 40 SCCM |

The resultant light receiving member was engaged in the same image-making tests as in Example 1.

As a result, there were obtained satisfactory results as in Example 1.

EXAMPLE 53 TO 63

There were provided eleven aluminum cylinders which are the same kind as used in Example 1.

There were formed a photoconductive layer and a surface layer on each aluminum cylinder to prepare a light receiving member for use in electrophotography using the apparatus shown in FIG. 5.

The formation of the surface layer for each of the eleven light receiving members was conducted in accordance with the procedures of Example 1.

That is, the flow rates of $SiH_4$ gas and $O_2$ gas were automatically changed using microcomputer so that the distributing concentration state of oxygen atoms in the layer became respectively as shown in FIG. 6(B) to FIG. 6(L), whereby a layer composed of A-Si:O:H to be the surface layer was formed in respective cases.

The resultant eleven light receiving members were engaged in the same image-making tests as in Example 1.

As a result, there were obtained satisfactory results on every light receiving member as in Example 1.

EXAMPLES 64 TO 75

There were provided twelve aluminum cylinders which are of the same kind as used in Example 1.

In each case of Examples 64 to 65, there were formed a charge injection inhibition layer, a photoconductive layer and a surface layer in this order on the surface of the aluminum cylinder under the layer forming conditions shown in Table L using the apparatus shown in FIG. 7.

In the formation of the surface layer, the flow rates of $SiH_4$ gas and $O_2$ gas were automatically changed using microcomputer so that the distributing concentration state of oxygen atoms in the layer became respectively as shown in FIG. 6(A) to FIG. 6(L), whereby a layer composed of A-Si:O:H to be the surface layer was formed in respective cases.

The resultant light receiving member was engaged in the same image-making tests as in Example 1.

As a result, there were obtained satisfactory results as in Example 1.

TABLE L

| Name of layer | Gas used | Flow rate (SCCM) | Discharging power (W) | Layer thickness (μm) |
|---|---|---|---|---|
| Charge injection inhibition layer | $SiH_4$ | 200 | | |
| | $H_2$ | 300 | | 3.0 |
| | $B_2H_6/H_2$ | 1000 to 0 ppm($B_2H_6$) | | |
| Photoconductive layer | $SiH_4$ | 200 | 200 | |
| | $H_2$ | 300 | | 22 |
| Surface layer | $SiH_4$ | 200 to 50 | | |
| | $H_2$ | 300 | | 1.0 |
| | $O_2$ | 5 to 50 | | |

Temperature of substrate: 250° C.
Discharging power frequency: 13.56 MHz

EXAMPLES 76 TO 87

There were provided twelve aluminum cylinders which are of the same kind as used in Example 1.

In each case of Examples 76 to 87, there were formed a charge injection inhibition layer, a photoconductive layer and a surface layer in this order on the surface of the aluminum cylinder under the layer forming conditions shown in Table M using the apparatus shown in FIG. 7.

In the formation of the surface layer, the flow rates of $SiH_4$ gas and $O_2$ gas were automatically changed using microcomputer so that the distributing concentration state of oxygen atoms in the layer became respectively as shown in FIG. 6(A) to FIG. 6(L), whereby a layer composed of A-Si:O:H to be the surface layer was formed in respective cases.

The resultant light receiving member was engaged in the same image-making tests as in Example 1.

As a result, there were obtained satisfactory results as in Example 1.

TABLE M

| Name of layer | Gas used | Flow rate (SCCM) | Discharging power (W) | Layer thickness (μm) |
|---|---|---|---|---|
| charge injection inhibition layer | $SiH_4$ | 150 | | |
| | $SiF_4$ | 50 | | 3.0 |
| | $H_2$ | 300 | | |
| | $B_2H_6/H_2$ | 100 to 0 ppm ($B_2H_6$) | | |
| Photo-conductive layer | $SiH_4$ | 150 | 200 | 22 |
| | $SiF_4$ | 50 | | |
| | $H_2$ | 300 | | |
| Surface layer | $SiH_4$ | 200 to 10 | | 1.0 |
| | $H_2$ | 300 | | |
| | $O_2$ | 5 to 50 | | |

Temperature of substrate: 250° C.
Discharging power frequency: 13.56 MHz

EXAMPLES 88 TO 89

In each of Examples 88 to 99, there was prepared an electrophotographic photosensitive member in drum form having an IR absorptive layer, a charge injection inhibition layer, a photoconductive layer and a surface layer for use in laser beam printer in which a 80 μm spot semiconductor laser of 780 nm in wavelength is used as the light source, using the apparatus shown in FIG. 7.

In every Example, an aluminum cylinder of 358 mm in length and 80 mm in diameter was used as the substrate.

Each of the twelve light receiving members was prepared as follows in accordance with the procedures as in Example 1.

That is, after the related inner atmosphere of the deposition chamber was brought to a predetermined vacuum and the aluminum cylinder was heated to a predetermined temperature, $H_2$ gas, $SiH_4$ gas, NO gas and $GeH_4$ gas were introduced into the deposition chamber respectively at a flow rate of 300 SCCM, 200 SCCM, 15 SCCM and 100 SCCM. At the same time, $B_2H_6/H_2$ gas was also introduced thereinto at a flow rate corresponding to 3000 ppm as for $B_2H_6$ against the $SiH_4$ gas.

After the inner pressure became stable at 0.5 Torr, a high frequency power energy of 200 W was applied to thereby generate gas plasmas, whereby an A-SiGe:H:B:N:O layer of 1 μm in thickness to be the IR absorptive layer was formed on the aluminum cylinder. Stopping the introduction of the $GeH_4$ gas, the above procedures were repeated to thereby form an A-Si:H:B:N:O layer of 5 μm in thickness to be the charge injection inhibition layer on the previous layer.

Successively, stopping the introduction of the NO gas and the $B_2H_6/H_2$ gas, the above procedures were repeated to thereby form an A-Si:H layer to be the photoconductive layer on the charge injection inhibition layer.

Then, introducing $O_2$ gas into the deposition chamber a surface layer of 0.5 μm in thickness containing oxygen atoms respectively in the distributing concentration state of the oxygen atoms as shown in FIG. 6(A) to FIG. 6(L) was formed on the photoconductive layer respectively to thereby obtain twelve light receiving members.

Each of the resultant twelve light receiving members was set to Canon's NP 9030 laser copier and the image-making tests were conducted thereon by the same procedures as in Example 1. As a result, satisfactory results were obtained on every light receiving member as in Example 1.

EXAMPLES 100 TO 111

There were provided twelve aluminum cylinders of the same kind as used in Example 1.

There were formed a photoconductive layer and a surface layer on each aluminum cylinder to prepare a light receiving member for use in electrophotography using the apparatus shown in FIG. 5.

For the photoconductor layer, oxygen atoms were incorporated into the layer aiming at improving the electrification efficiency and the sensitivity.

For the information of the photoconductive layer in each case, the procedures of Example 1 were repeated, except than $SiH_4$ gas, $H_2$ gas and $CH_4$ gas were introduced into the deposition chamber respectively at a flow rate of 200 SCCM, 300 SCCM and 1 SCCM, to thereby form a layer of 25 μm in thickness to be the photoconductive layer.

Then, in accordance with the procedures of Example 1 for the formation of the surface layer, a layer of 0.5 μm in thickness to be the surface layer was formed in each case while incorporating oxygen atoms into the layer in the distributing concentration state of the oxygen atoms respectively as shown in FIG. 6(A) to FIG. 6(L) by changing the flow rates of $SiH_4$ gas and $CH_4$ gas under automatic control with microcomputer.

The resultant twelve light receiving members were evaluated by the procedures of Example 1.

As a result, satisfactory results were obtained on every light receiving member as in Example 1.

EXAMPLE 112

In this example, there was prepared an electrophotographic photosensitive member in drum form for use in electrophotographic copying system in which a halogen lamp is used as the light source and a filter to cut off a long wavelength light is together used in order to rise the color sensitivity.

As the substrate, an aluminum cylinder of the same kind as in Example 1 was used.

On the aluminum cylinder, there were formed a photoconductive layer then a surface layer having a layer thickness of 0.5 μm which is composed with an A-Si:N:H.

The formation of the A-Si:N:H layer as the surface layer was conducted by changing the flow rates of $SiH_4$ gas and $NH_3$ gas under the layer forming conditions shown in Table N so that the distributing concentration state in the layer became as shown in FIG. 6(A).

TABLE N

| Gas used | Initial Stage | | Final Stage |
|---|---|---|---|
| $H_2$ | 300 SCCM | | 300 SCCM |
| $SiH_4$ | 200 SCCM | to | 50 SCCM |
| $NH_3$ | 5 SCCM | to | 100 SCCM |

The resultant light receiving member was engaged in the same image-making tests as in Example 1.

As a result, there were obtained satisfactory results as in Example 1.

EXAMPLE 113

In this example, there was prepared a light receiving member having a photoconductive layer and a layer composed of A-SiN:H:O to be the surface layer on the same kind of aluminum cylinder as in Example 1 in accordance with the same procedures as in the case of Example 1

The formation of the A-SiN:H:O layer as the surface layer was conducted by changing the flow rates of $SiH_4$ gas and $NO_2$ gas under the layer forming conditions shown in Table O so that the distributing concentration states of the oxygen atoms and the nitrogen atoms in the layer became as shown in FIG. 6(A).

TABLE O

| Gas used | Initial Stage | | Final Stage |
|---|---|---|---|
| $H_2$ | 300 SCCM | | 300 SCCM |
| $SiH_4$ | 200 SCCM | to | 50 SCCM |
| $NO_2$ | 5 SCCM | to | 50 SCCM |

The resultant light receiving member was engaged in the same image-making tests as in Example 1.

As a result, there were obtained satisfactory results as in Example 1.

EXAMPLE 114

In this example, there was prepared a light receiving member having a photoconductive layer and a layer composed of A-SiN:H:O to be the surface layer of 0.5 μm in thickness on the same kind of aluminum cylinder as in Example 1 in accordance with the same procedures as in the case of Example 1.

The formation of A-SiN:H:O layer as the surface layer was conducted by changing the flow rates of $SiH_4$ gas, $NH_3$ gas and $O_2$ gas under the layer forming conditions shown in Table P so that the distributing concentration state of carbon atoms in the layer became as shown in FIG. 6(A).

TABLE P

| Gas used | Initial Stage | | Final Stage |
|---|---|---|---|
| $H_2$ | 300 SCCM | | 300 SCCM |
| $SiH_4$ | 200 SCCM | to | 50 SCCM |
| $NH_3$ | 3 SCCM | to | 30 SCCM |
| $O_2$ | 2 SCCM | to | 20 SCCM |

The resultant light receiving member was engaged in the same image-making tests as in Example 1.

As a result, there were obtained satisfactory results as in Example 1.

EXAMPLE 115

In this example, there was prepared a light receiving member having a photoconductive layer and a layer composed of A-SiN:H:F to be the surface layer of 0.5 μm in thickness on the same kind of aluminum cylinder as in Example 1 in accordance with the same procedures as in the case of Example 1.

The formation of the A-SiN:H:F layer as the surface layer was conducted by changing the flow rates of $SiH_4$ gas, $SiF_4$ gas and $NH_3$ gas under the layer forming conditions shown in Table Q so that the distributing concentration state of nitrogen atoms in the layer became as shown in FIG. 6(A).

TABLE Q

| Gas used | Initial Stage | | Final Stage |
|---|---|---|---|
| $H_2$ | 300 SCCM | | 300 SCCM |
| $SiH_4$ | 150 SCCM | to | 30 SCCM |
| $SiF_4$ | 50 SCCM | to | 20 SCCM |
| $NH_3$ | 5 SCCM | to | 100 SCCM |

The resultant light receiving member was engaged in the same image-making tests as in Example 1.

As a result, there were obtained satisfactory results as in Example 1.

EXAMPLE 116

In this example, there was prepared a light receiving member having a photoconductive layer and a layer composed of A:SiN:H:O:C to be the surface layer of 0.5 μm in thickness on the same kind of aluminum cylinder as in Example 1 in accordance with the same procedures as in the case of Example 1.

The formation of the A:SiN:H:O:C layer as the surface layer was conducted by changing the flow rates of $SiH_4$ gas, $NO_2$ gas and $CH_4$ gas under the layer forming conditions shown in Table R so that the distributing concentration states of the nitrogen atoms, the oxygen atoms and the carbon atoms in the layer became as shown in FIG. 6(A).

TABLE R

| Gas used | Initial Stage | | Final Stage |
|---|---|---|---|
| $H_2$ | 300 SCCM | | 300 SCCM |
| $SiH_4$ | 200 SCCM | to | 50 SCCM |
| $NO_2$ | 3 SCCM | to | 30 SCCM |

TABLE R-continued

| Gas used | Initial Stage | | Final Stage |
|---|---|---|---|
| $CH_4$ | 2 SCCM | to | 20 SCCM |

The resultant light receiving member was engaged in the same image-making tests as in Example 1.

As a result, there were obtained satisfactory results as in Example 1.

EXAMPLE 117

In this example, there was prepared a light receiving member having a photoconductive layer and a layer composed of A-SiN:H:O:C to be surface layer of 0.5 μm in thickness on the same kind of aluminum cylinder as in Example 1 in accordance with the same procedures as in the case of Example 1.

The formation of the A-SiN:H:O:C layer as the surface layer was conducted by changing the flow rates of $SiH_4$ gas, $O_2$ gas and $NH_3$ gas and $CH_4$ gas under the layer forming conditions shown in Table S so that the distributing concentration states of oxygen atoms, nitrogen atoms and carbon atoms in the layer became as shown in FIG. 6(A).

TABLE S

| Gas used | Initial Stage | | Final Stage |
|---|---|---|---|
| $H_2$ | 300 SCCM | | 300 SCCM |
| $SiH_4$ | 200 SCCM | to | 50 SCCM |
| $O_2$ | 3 SCCM | to | 30 SCCM |
| $NH_3$ | 1 SCCM | to | 10 SCCM |
| $CH_4$ | 1 SCCM | to | 10 SCCM |

The resultant light receiving member was engaged in the same image-making tests as in Example 1.

As a result, there were obtained satisfactory results as in Example 1.

EXAMPLES 118 TO 128

There were provided eleven aluminum cylinders which are the same kind as used in Example 1.

There were formed a photoconductive layer and a surface layer on each aluminum cylinder to prepare a light receiving member for use in electrophotography using the apparatus shown in FIG. 5.

The formation of the surface layer for each of the eleven light receiving members was conducted in accordance with the procedures of Example 1.

That is, the flow rates of $SiH_4$ gas and gas were automatically changed using microcomputer so that the distributing concentration state of nitrogen atoms in the layer became respectively as shown in FIG. 6(B) to FIG. 6(L), whereby a layer composed of A-Si:N:H to be the surface layer was formed in respective cases.

The resultant eleven light receiving members were engaged in the same image-making tests as in Example 1.

As a result, there were obtained satisfactory results on every light receiving member as in Example 1.

EXAMPLES 129 TO 140

There were provided twelve aluminum cylinders which are of the same kind as used in Example 1.

In each case of Examples 129 to 140, there were formed a charge injection inhibition layer a photoconductive layer and a surface layer in this order on the surface of the aluminum cylinder under the layer forming conditions shown in Table T using the apparatus shown in FIG. 7.

In the formation of the surface layer, the flow rates of $SiH_4$ gas and $HN_3$ gas were automatically changed using microcomputer so that the distributing concentration state of nitrogen atoms in the layer became respectively as shown in FIG. 6(A) to FIG. 6(L), whereby a layer composed of A-Si:N:H having a thickness to be the surface layer was formed in respective cases.

The resultant light receiving member was engaged in the same image-making tests as in Example 1.

As a result, there were obtained satisfactory results as in Example 1.

TABLE T

| Name of layer | Gas used | Flow rate (SCCM) | Discharging power (W) | Layer thickness (μm) |
|---|---|---|---|---|
| Charge injection inhibition layer | $SiH_4$ | 200 | | |
| | $H_2$ | 300 | | 3.0 |
| | $B_2H_6/H_2$ | 1000 to 0 ppm($B_2H_6$) | | |
| Photoconductive layer | $SiH_4$ | 200 | 200 | |
| | $H_4$ | 300 | | 22 |
| Surface layer | $SiH_4$ | 200 to 10 | | |
| | $H_2$ | 300 | | 1.0 |
| | $HN_3$ | 50 to 100 | | |

Temperature of substrate: 250° C.
Discharging power frequency: 13.56 MHz

EXAMPLE 141 TO 152

There were provided twelve aluminum cylinders which are of the same kind as used in Example 1.

In each case of Examples 141 to 152, there were formed a charge injection inhibition layer, a photoconductive layer and a surface layer in this order on the surface of the aluminum cylinder under the layer forming conditions shown in Table U using the apparatus shown in FIG. 7.

In the formation of the surface layer, the flow rates of $SiH_4$ gas and $NH_3$ gas were automatically changed using microcomputer so that the distributing concentration state of nitrogen atoms in the layer became respectively as shown in FIG. 6(A) to FIG. 6(L), whereby a layer composed of A-Si:N:H to be the surface layer was formed in respective cases.

The resultant light receiving member was engaged in the same image-making tests as in Example 1.

As a result, there were obtained satisfactory results as in Example 1.

TABLE U

| Name of layer | Gas used | Flow rate (SCCM) | Discharging power (W) | Layer thickness (μm) |
|---|---|---|---|---|
| Charge injection inhibition layer | $SiH_4$ | 150 | | |
| | $SiF_4$ | 50 | | 3.0 |
| | $H_2$ | 300 | | |
| | $B_2H_6/H_2$ | 1000 to 0 ppm($B_2H_6$) | | |
| Photoconductive layer | $SiH_4$ | 150 | 200 | |
| | $SiF_4$ | 50 | | |
| | $H_2$ | 300 | | 22 |
| Surface layer | $SiH_4$ | 200 to 10 | | |
| | $H_2$ | 300 | | 1.0 |
| | $NH_3$ | 5 to 100 | | |

Temperature of substrate: 250° C.
Discharging power frequency: 13.56 MHz

EXAMPLES 153 TO 164

In each of Examples 153 to 164, there was prepared an electrophotographic photosensitive member in drum form having an IR absorptive layer, a charge injection inhibition layer, a photoconductive layer and a surface layer for use in laser beam printer in which a 80 μm spot semiconductor laser of 780 nm in wavelength is used as the light source, using the apparatus shown in FIG. 7.

In every example, an aluminum cylinder of 358 mm in length and 80 mm in diameter was used as the substrate.

Each of the twelve light receiving members was prepared as follows in accordance with the procedures as in Example 1.

That is, after the related inner atmosphere of the deposition chamber was brought to a predetermined vacuum and the aluminum cylinder was heated to a predetermined temperature, $H_2$ gas, $SiH_4$ gas, NO gas and $GeH_4$ gas were introduced into the deposition chamber respectively at a flow rate of 300 SCCM, 200 SCCM, 15 SCCM and 100 SCCM. At the same time, $B_2H_6/H_2$ gas was also introduced thereinto at a flow rate corresponding to 3000 ppm as for $B_2H_6$ against the $SiH_4$ gas.

After the inner pressure became stable at 0.5 Torr, a high frequency power energy of 200 W was applied to thereby generate gas plasmas, whereby an A-SiGe:H:B:N:O layer of 1 μm in thickness to be the IR absorptive layer was formed on the aluminum cylinder. Stopping the introduction of the $GeH_4$ gas, the above procedures were repeated to thereby form an A-Si:H:B:N:O layer of 5 μm in thickness to be the charge injection inhibition layer on the previous layer.

Successively, stopping the introduction of the NO gas and the $B_2H_6/H_2$ gas, the above procedures were repeated to thereby form an A-Si:H layer to be the photoconductive layer on the charge injection inhibition layer.

Then, introducing NO gas into the deposition chamber, a surface layer of 0.5 μm in thickness containing nitrogen atoms and oxygen atoms in the distributing concentration states of the nitrogen atoms and oxygen atoms as shown in FIG. 6(A) to FIG. 6(L) was formed on the photoconductive layer respectively to thereby obtain twelve light receiving members.

Each of the resultant twelve light receiving members was set to Canon's NP 9030 laser copier and the image-making tests were conducted thereon by the same procedures as in Example 1. As a result, satisfactory results were obtained on every light receiving member as in Example 1.

EXAMPLES 165 TO 176

There were provided twelve aluminum cylinders of the same kind as used in Example 1.

There were formed a photoconductive layer and a surface layer on each aluminum cylinder to prepare a light receiving member for use in electrophotography using the apparatus shown in FIG. 5.

For the photoconductive layer, oxygen atoms were incorporated into the layer aiming at improving the electrification efficiency and the sensitivity.

For the formation of the photoconductive layer in each case, the procedures of Example 1 were repeated, except that $SiH_4$ gas, $H_2$ gas and $CH_4$ gas were introduced into the deposition chamber respective at a flow rate of 200 SCCM, 300 SCCM and 1 SCCM, to thereby form a layer of 25 Dμm in thickness to be the photoconductive layer.

Then, in accordance with the procedures of Example 1 for the formation of the surface layer, a layer of 0.5 μm in thickness to be the surface layer was formed in each case while incorporating nitrogen atoms into the layer in the distributing concentration state of the oxygen atoms respectively as shown in FIG. 6(A) to FIG. 6(L) by changing the flow rates of $SiH_4$ gas and $NH_3$ gas under automatic control with microcomputer.

The resultant twelve light receiving members were evaluated by the procedure of Example 1.

As a result, satisfactory results were obtained on every light receiving member as in Example 1.

What we claim is:

1. A light receiving member suitable for use in a high-speed image-making system which comprises at least a substrate and a light receiving layer, said light receiving layer comprising from the substrate side:

(i) a photoconductive layer from 3 to 100 microns in thickness of a material selected from (a) an amorphous material containing silicon atoms as a matrix and at least one kind selected from hydrogen atoms and halogen atoms and (b) an amorphous material containing silicon atoms as a matrix, at least one kind selected from germanium atoms and tin atoms, and at least one kind selected from hydrogen atoms and halogen atoms, and (ii) a surface layer from 0.003 to 30 microns in thickness having a free surface and formed of an amorphous material containing silicon atoms and at least one kind selected from the group consisting of carbon atoms, oxygen atoms and nitrogen atoms (C,O,N) in a total amount of 0.5 to 95 atomic percent; said atoms (C,O,N) being present in a concentration sufficient to provide a refractive index value for the portion of the surface layer at the interface between the photoconductive layer and the surface layer such that the difference in refractive index (Δn) between the refractive index of the photoconductive layer and the refractive index of the portion of the surface layer at the interface is no greater that 0.62 and wherein the difference $\Delta E_{gopt}$ between the optical band gap of the portion of the surface layer at said interface and the optical band gap of the photoconductive layer is no less than 0.01, wherein the atoms (C,N,O) are present in a low concentration at the interface side of the surface layer and are present in a high concentration at the free surface side of the surface layer and whereby said Δn and said $\Delta E_{gopt}$ values tending to inhibit formation of interference fringe and ghost images, without compromising spectral sensitivity of said light receiving member.

2. The light receiving member according to claim 1, wherein said concentration of the atoms (C,O,N) is gradually increased from the interface between the photoconductive layer and the surface layer in the thickness direction toward the free surface of the surface layer.

3. The light receiving member according to claim 1, wherein the substrate is electrically insulative.

4. The light receiving member according to claim 1, wherein the substrate is electroconductive.

5. The light receiving member according to claim 1, wherein the substrate is an aluminum alloy.

6. The light receiving member according to claim 1, wherein the substrate is cylindrical in form.

7. The light receiving member according to claim 1, wherein the substrate has an uneven surface.

8. The light receiving member according to claim 1, wherein the photoconductive layer contains an element of Group III of the Periodic Table.

9. The light receiving member according to claim 8, wherein said element is selected from the group consisting of B, Al, Ga, In and Tl.

10. The light receiving member according to claim 8, wherein the amount of said element contained in the photoconductive layer is from 0.001 to 3000 atomic ppm.

11. The light receiving member according to claim 1, wherein the photoconductive layer contains an element of Group V of the Periodic Table.

12. The light receiving member according to claim 11, wherein said element is selected from the group consisting of P, As, Sb and Bi.

13. The light receiving member according to claim 11, wherein the amount of said element contained in the photoconductive layer is from 0.001 to 3,000 atomic ppm.

14. The light receiving member according to claim 1, wherein the photoconductive layer contains 1 to 40 atomic % of said hydrogen atoms.

15. The light receiving member according to claim 1, wherein the photoconductive layer contains 1 to 40 atomic % of said halogen atoms.

16. The light receiving member according to claim 1, wherein the photoconductive layer contains the hydrogen atoms and the halogen atoms in a total amount of 1 to 40 atomic %.

17. The light receiving member according to claim 1, wherein the photoconductive layer contains at least one kind selected from the group consisting of oxygen atoms, carbon atoms and nitrogen atoms.

18. The light receiving member according to claim 17, wherein the amount of the oxygen atoms contained in the photoconductive layer is from 10 to $5\times10^5$ atomic ppm.

19. The light receiving member according to claim 17, wherein the amount of the carbon atoms contained in the photoconductive layer is from 10 to $5\times10^5$ atomic ppm.

20. The light receiving member according to claim 17, wherein the amount of the nitrogen atoms contained in the photoconductive layer is from 10 to $5\times10^5$ atomic ppm.

21. The light receiving member according to claim 17, wherein the sum of the oxygen atoms, the carbon atoms and the nitrogen atoms contained in the photoconductive layer is from 10 to $5\times10^5$ atomic ppm.

22. The light receiving member according to claim 1, wherein the surface layer contains at least one kind selected from hydrogen atoms and halogen atoms.

23. The light receiving member according to claim 22, wherein the surface layer contains 1 to 70 atomic % of said hydrogen atoms.

24. The light receiving member according to claim 22, wherein the surface layer contains 1 to 70 atomic % of said halogen atoms.

25. The light receiving member according to claim 22, wherein the surface layer contains the hydrogen atoms and the halogen atoms in a total amount of 1 to 70 atomic %.

26. The light receiving member according to claim 1, wherein a charge injection inhibition layer from 30 Å to 10 microns in thickness is disposed between the substrate and the photoconductive layer.

27. The light receiving member according to claim 26, wherein the charge injection inhibition layer comprises a non-single-crystal material containing silicon atoms as a matrix, an element selected from the group consisting of Group III and V elements of the Periodic Table in an amount of 3 to $5\times10^4$ atomic ppm and at least one kind selected from hydrogen atoms and halogen atoms in a total amount of $1\times10^3$ to $7\times10^5$ atomic ppm.

28. The light receiving member according to claim 27, wherein said non-single-crystal material additionally contains at least one kind selected from the group consisting of oxygen atoms, nitrogen atoms and carbon atoms in a total amount of 0.001 to 50 atomic %.

29. The light receiving member according to claim 28, wherein a long wavelength light absorption layer from 30 Å to 50 microns in thickness is disposed between the substrate and the charge injection inhibition layer.

30. The light receiving member according to claim 29, wherein the long wavelength light absorption layer comprises a non-single-crystal material containing silicon atoms as a matrix, at least one kind selected from germanium atoms and tin atoms in a total amount of 1 to $1\times10^6$ atomic ppm, and at least one kind selected from hydrogen atoms and halogen atoms.

31. An electrophotographic process comprising:

(a) applying an electric field to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 1

Line 10, "continueous" should read --continuous--.
Line 29, "ber" should read --bers--.
Line 30, "the." should read --use.--.
Line 41, "chargein" should read --charge in--.
Line 54, "kind atoms" should read --kind of atoms--.
Line 63, "an" should read --a--.

COLUMN 2

Line 52, "members" should read --member--.
Line 55, "light laser" should read --light such as laser--.
Line 57, "in digital" should read --in a digital--.
Line 58, "in a" should be deleted.
Line 61, "ray" should read --rays--.
Line 64, "a" should be deleted.
Line 65, "be" should be deleted.
Line 66, "to" (first occurrence) should be deleted.

COLUMN 3

Line 44, "on conventional" should read --on the conventional--.
Line 55, "regards" should read --regard--.

COLUMN 4

Line 35, "repeating" should read --repeated--.
Line 45, "kind" should read --kind of--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 4

Line 46, "carbon atoms (c), oxygen atoms (o)" should read --carbon atoms (C), oxygen atoms (O)--.
Line 53, "kind atom" should read --kind of atom--.
Line 54, "(C), oxygen (O) and nitrogen (N)" should read --atom (C), oxygen atom (O) and nitrogen atom (N)--.

COLUMN 5

Line 8, "a" should read --an--.
Line 23, "a" should read --an--.
Line 59, "continueous" should read --continuous--.
Line 61, "Experiments 1 and 3" should read --Experiments 1 to 3--.
Line 67, "index is" should read --index difference is--.
Line 68, "$\Delta n \geqq 0.62$" should read --$\Delta n \leqq 0.62$-- and "$\Delta n \geqq 0.43$." should read --$\Delta n \leqq 0.43$.--.

COLUMN 6

Line 3, "relation" should read --relations--.

COLUMN 7

Line 42, "Plank's" should read --Planck's--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 8

Line 29, "regards" should read --regard--.
Lines 30-31, "supremum" should read --optimum--.
Line 49, "tinueously" should read --tinuously--.
Line 60, "continueously" should read --continuously--.
Line 61, "discharge" should read --discharging--.

COLUMN 9

TABLE A, "Change" should read --Charge--.

COLUMN 10

Line 58, "carve" should read --curve--.

COLUMN 11

Line 27, "continueous" should read --continuous--.

COLUMN 12

Line 55, "kind atoms" should read --kind of atoms--.

COLUMN 13

Line 15, "sehematic" should read --schematic--.
Line 16, "kind atoms" should read --kind of atoms--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 14

Line 1, "stailess steels," should raed --stainless steels,--.

COLUMN 15

Line 22, "kind" should read --kind of--.
Line 30, "kind atoms" should read --kind of atoms--.
Line 35, "$3X10^{-3}$ 30 atomic %." should read --$3X10^{-3}$ to 30 atomic %--.

COLUMN 16

Line 17, "Ti (thallium)" should read --Tl (thallium)--.
Line 33, "incorporate" should read --incorporated--.
Line 37, "it" should read --its--.
Line 49, "regards" should read --regard--.
Line 67, "repeating" should read --repeated--.

COLUMN 17

Line 18, "constituted" should read --constituted of--.
Line 19, "kind atoms" should read --kind of atoms--.
Line 22, "halogen atoms (N)," should read --halogen atoms (X),--.
Line 23, "kind atoms" should read --kind of atoms--.
Line 24, "nitrogen atoms" should read --nitrogen atoms (N),--.
Line 53, "incorporate" should read --incorporated--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 18

Line 51, "kind atoms" should read --kind of atoms--.

COLUMN 19

Line 11, "half tone" should read --halftone--.
Line 47, "germanium atoms," should read --germanium atoms (Ge),--.

COLUMN 21

Line 21, "or" should read --for--.
Line 42, "determined" should read --be determined--.

COLUMN 22

Line 5, "$Si_4O_{10}$," should read --$Si_4H_{10}$,--.
Line 10, "contrpl" should read --control--.
Line 29, "butine(Chd $4H_6$)." should read --butine($C_4H_6$).--.
Line 55, "intented" should read --intended--.
Line 58, "electrophto-" should read --electrophoto- --.
Line 60, "holo-" should read --halo- --.
Line 62, "rise" should read --raise--.
Line 68, "a" (second occurrence) should read --an--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 23

Line 6, "surves" should read --serves--.
Line 7, "determine" should read --determined--.
Line 8, "aneal" should read --anneal--.
Line 10, "cathod," should read --cathode,--.
Line 16, "cathod" should read --cathode--.
Line 17, "cathod" should read --cathode--.
Line 29, "valves 541" should read --valves, 541--.
Line 37, "C, O or H" should read --C, O or N--.

COLUMN 24

Line 3, "maintained" should read --was maintained--.
Line 48, "a" should read --an--.

COLUMN 25

Line 53, "80 in" should read --80 mm in--.

COLUMN 26

Line 5, "for" should read --form--.
Line 17, "6(L) on" should read --6(L) was formed on--.
Line 38, "Example" should read --Example 1--.
Line 55, "example 1." should read --Example 1.--.
Line 63, "rise" should read --raise--.
Line 66, "Example" should read --Example 1--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 27

Line 6, "obygen" should read --oxygen--.
Line 8, "FIG. 6(A)" should read --FIG. 6(A).--.
Line 23, "surface layer" should read --the surface layer--.

COLUMN 28

Line 33, "EXAMPLE 53 TO 63" should read --EXAMPLES 53 TO 63--.
Line 59, "Examples 64 to 65," should read --Examples 64 to 75,--.

COLUMN 30

Line 57, "information" should read --formation--.
Line 59, "than" should read --that--.

COLUMN 31

Line 14, "rise" should read --raise--.

COLUMN 33

Line 49, "$SiH_4$ gas and gas" should read --$SiH_4$ gas and $H_2$ gas--.
Line 66, "layer a" should read --layer, a--.

UNITED STATES PATENT AND TRADEMARK OFFICE

CERTIFICATE OF CORRECTION

PATENT NO. : 4,795,691

DATED : January 3, 1989

INVENTOR(S) : TETSUYA TAKEI, ET AL.

It is certified that error appears in the above-identified patent and that said Letters Patent is hereby corrected as shown below:

COLUMN 34

Line 31, "EXAMPLE 141 TO 152" should read --EXAMLES 141 TO 152--.

COLUMN 35

Line 67, "respective" should read --respectively--.

COLUMN 36

Line 1, "25 Dμm" should read --25 μm--.

COLUMN 37

Line 22, "3,000 atomic" should read --3000 atomic--.

COLUMN 38

Line 35, "28," should read --26,--.

Signed and Sealed this

Nineteenth Day of November, 1991

*Attest:*

HARRY F. MANBECK, JR.

*Attesting Officer*

*Commissioner of Patents and Trademarks*